United States Patent [19]

Beck

[11] Patent Number: 4,537,258

[45] **Date of Patent: * Aug. 27, 1985**

[54] LOW PRESSURE RESPONSIVE DOWNHOLE TOOL

[75] Inventor: Harold K. Beck, Duncan, Okla.

[73] Assignee: Halliburton Company, Duncan, Okla.

[ * ] Notice: The portion of the term of this patent subsequent to Dec. 25, 2001 has been disclaimed.

[21] Appl. No.: 533,835

[22] Filed: Sep. 19, 1983

[51] Int. Cl.[3] ..... E21B 34/08

[52] U.S. Cl. ..... 166/374; 166/331

[58] Field of Search ..... 166/374, 319, 321, 324, 166/325, 332, 334, 386, 387, 264, 331

[56] References Cited

U.S. PATENT DOCUMENTS

| | | | |
|---|---|---|---|
| Re. 29,562 | 3/1978 | Wray et al. | 166/321 X |
| 2,740,479 | 3/1956 | Schwegman | 166/264 X |
| 3,358,755 | 12/1967 | Chisholm | 173/119 |
| 3,431,985 | 3/1969 | Bowen | 166/264 X |
| 3,646,995 | 3/1972 | Manes et al. | 166/264 X |
| 3,664,415 | 5/1972 | Wray et al. | 166/264 X |
| 3,782,461 | 1/1974 | Watkins | 166/321 X |
| 3,796,261 | 3/1974 | Nutter | 166/237 |
| 3,814,182 | 6/1974 | Giroux | 166/331 |
| 3,823,773 | 7/1974 | Nutter | 166/250 X |
| 3,842,913 | 10/1974 | Mott | 166/321 X |
| 3,850,250 | 11/1974 | Holden et al. | 166/321 X |
| 3,856,085 | 12/1974 | Holden et al. | 166/264 X |
| 3,858,649 | 1/1975 | Wray et al. | 166/264 X |
| 3,860,069 | 1/1975 | Wray et al. | 166/264 |
| 3,870,104 | 3/1975 | Mott | 166/321 X |
| 3,915,228 | 10/1975 | Giebeler | 166/321 X |
| 3,930,540 | 1/1976 | Holden et al. | 166/321 X |
| 3,964,305 | 6/1976 | Wray et al. | 166/321 X |
| 3,964,544 | 6/1976 | Farley et al. | 166/321 X |
| 3,976,136 | 8/1976 | Farley et al. | 166/321 X |
| 4,047,564 | 9/1977 | Nix et al. | 166/334 X |
| 4,058,165 | 11/1977 | Holden et al. | 166/321 X |
| 4,059,153 | 11/1977 | Nix et al. | 166/321 X |
| 4,063,593 | 12/1977 | Jessup | 166/321 X |
| 4,076,077 | 2/1978 | Nix et al. | 166/321 X |
| 4,109,724 | 8/1978 | Barrington | 166/321 X |
| 4,109,725 | 8/1978 | Williamson et al. | 166/321 X |
| 4,113,012 | 9/1978 | Evans et al. | 166/321 X |
| 4,144,937 | 3/1979 | Jackson et al. | 166/332 X |
| 4,341,266 | 7/1982 | Craig | 166/321 X |

*Primary Examiner*—Stephen J. Novosad
*Assistant Examiner*—Thuy M. Bui
*Attorney, Agent, or Firm*—Lucian W. Beavers; James R. Duzan; Thomas R. Weaver

[57] ABSTRACT

An annulus pressure responsive downhole tool includes a housing having a power piston slidably disposed therein. First and second pressure conducting passages communicate a well annulus with first and second sides of the power piston. A retarding device is disposed in the second pressure conducting passage for delaying communication of a sufficient portion of an increase in well annulus pressure to the second side of the power piston for a sufficient time to allow a pressure differential across the power piston to move the power piston from a first position to a second position relative to the housing. A pressure relief valve is communicated with the second pressure conducting passage between the power piston and the retarding device for relieving from the second pressure conducting passage a volume of fluid sufficient to permit the power piston to travel to its second position.

38 Claims, 26 Drawing Figures

LOW PRESSURE RESPONSIVE DOWNHOLE TOOL

BACKGROUND OF THE INVENTION

1. Field of the Invention:

The present invention relates to annulus pressure responsive downhole tools. Particularly, the present invention provides an improved design for an annulus pressure responsive downhole tool which eliminates the need for using a large volume of compressible liquid or a volume of compressible gas within the tool to compensate for the volume displaced by a power piston of the tool.

2. Description of the Prior Art

It is well known in the art that downhole tools such as testing valves, circulating valves and samplers can be operated by varying the pressure of fluid in a well annulus and applying that pressure to a differential pressure piston within the tool.

The predominant method of creating the differential pressure across the differential pressure piston has been to isolate a volume of fluid within the tool at a fixed reference pressure. Such a fixed reference pressure has been provided in any number of ways.

One manner of providing a fixed reference pressure is by providing an essentially empty sealed chamber on the low pressure side of the power piston, which chamber is merely filled with air at the ambient pressure at which the tool was assembled. Such a device is shown for example in U.S. Pat. No. 4,076,077 to Nix et al. with regard to its sealed chamber 42. This type of device does not balance hydrostatic annulus pressure across the power piston as the tool is run into the well.

Another approach has been to provide a chamber on the low pressure side of the piston, and fill that chamber with a charge of inert gas such as nitrogen. Then, when the annulus pressure overcomes the gas pressure, the power piston is moved by that pressure differential, and the gas compresses to allow the movement of the power piston. Such a device is shown for example in U.S. Pat. No. 3,664,415 to Wray et al. with regard to its nitrogen cavity 44. This type of device does not balance hydrostatic annulus pressure across the power piston as the tool is run into the well.

Another approach has been to use a charge of inert gas as described above, in combination with a supplementing means for supplementing the gas charge pressure with hydrostatic pressure of the fluid in the annulus contained between the well bore and the test string, as the test string is lowered into the well. Such a device is shown for example in U.S. Pat. No. 3,856,085 to Holden et al. When a tool of this type has been lowered to the desired position in the well, the inert gas pressure is supplemented by the amount of the hydrostatic pressure in the well at that depth. Then, an isolation valve is closed which then traps in the tool a volume of well annulus fluid at a pressure substantially equal to the hydrostatic pressure in the well annulus at that depth. Once the isolation valve has closed, the reference pressure provided by the inert gas is no longer effected by further increases in well annulus pressure. Then well annulus pressure may be increased to create a pressure differential across the power piston to actuate the tool.

Also, rather than utilize a compressible inert gas such as nitrogen within such tools, it has been proposed to use a large volume of a somewhat compressible liquid such as silicone oil on the low pressure side of the piston. Such a device is seen for example in U.S. Pat. No. 4,109,724 to Barrington.

One recent device which has not relied upon either a large volume of compressible liquid or a volume of compressible gas is shown in U.S. Pat. No. 4,341,266 to Craig. This is a trapped reference pressure device which uses a system of floating pistons and a differential pressure valve to accomplish actuation of the tool. The reference pressure is trapped by a valve which shuts upon the initial pressurizing up of the well annulus after the packer is set. The Craig tool does balance hydrostatic pressure across its various differential pressure components as it is run into the well.

Another relatively recent development is shown in U.S. Pat. No. 4,113,012 to Evans et al. The device utilizes fluid flow restrictors 119 and 121 to create a time delay in any communication of changes in well annulus pressure to the lower side of its power piston. During this time delay the power piston moves from a first to a second position. The particular tool disclosed by Evans et al. utilizes a compressed nitrogen gas chamber in combination with a floating shoe which transmits the pressure from the compressed nitrogen gas to a non-compressible liquid filled chamber. This liquid filled chamber is communicated with a well annulus through pressurizing and depressurizing passages, each of which includes one of the fluid flow restrictors plus a back pressure check valve. Hydrostatic pressure is balanced across the power piston as the tool is run into the well, except for the relatively small differential created by the back pressure check valve in the pressurizing passage.

With most of these prior art devices, there has been the need to provide either a large volume of compressible liquid or a volume of compressible gas to account for the volume change within the tool on the low pressure side of the power piston. This compressible liquid or gas has generally either been silicone oil or nitrogen. There are disadvantages with both of these.

When utilizing a tool which provides a sufficient volume of compressible silicone oil to accommodate the volume change required on the low pressure side of the power piston, the tool generally becomes very large because of the large volume of silicone oil required in view of its relatively low compressibility.

On the other hand, there is a danger in tools that utilize an inert gas, such as nitrogen, as in any high pressure vessel.

Furthermore, most of these prior art tools have required relatively high annulus pressure increases, sometimes as high as 2000 psi, for operation.

SUMMARY OF THE INVENTION

The present invention provides a very much improved annulus pressure responsive tool which operates in response to a relatively low increase in annulus pressure, and which also eliminates the problems of dealing with either a large volume of compressible liquid or a pressurized volume of compressible gas in order to provide for the volume change on the low pressure side of the moving power piston.

The present invention provides an annulus pressure responsive downhole tool apparatus which includes a tool housing having a power piston slidably disposed in the housing. A first pressure conducting passage communicates the well annulus with a first side of the power piston. A second pressure conducting passage communicates the well annulus with a second side of the power piston. A retarding means, is disposed in the second pressure conducting passage for delaying communication of a sufficient portion of an increase in well annulus pressure to the second side of the power piston for a sufficient time to allow a pressure differential from the first side to the second side of the power piston to move the power piston from a first position to a second position relative to the housing. A pressure relief means is communicated with the second pressure conducting passage, between the second side of the piston and the retarding means, for relieving from the second pressure conducting passage a volume of fluid sufficient to permit the power piston to travel to its second position.

It is this pressure relief means, which relieves fluid from the low pressure side of the power piston, which eliminates the need for using either a compressible gas or a large volume of compressible liquid on the low pressure side of the power piston.

The use of the pressure relief means to accommodate the fluid displaced by the power piston, instead of using a large volume of compressible liquid or a pressurized volume of gas provides a number of advantages.

Since no pressurized nitrogen is used, the dangers associated with the use of pressurized nitrogen are eliminated.

Very significantly, the pressures which must be applied to the well annulus to operate the tools of the present invention are very much reduced as compared to most prior art tools.

Also, the present invention provides a tool which always actuates at the same differential operating pressure. Tools which rely upon compressible liquids or compressible gas do not have constant differential operating pressures because the compressibility of the silicone oil and the nitrogen is non-linear.

The tools of the present invention can be operated with a differential operating pressure of as little as 200–500 psi. This is determined by the strength of the return spring located below the power piston. Thus, if an actual well annulus pressure increase of 1000 psi is used to actuate the tool of the present invention, a wide margin of error is provided assuring that the tool will in fact be actuated.

Prior art tools, particularly those relying upon the compression of silicone oil, require much higher differential operating pressures as high as 2000 psi.

This is particularly important in view of the fact that, assuming the tool in question is a tester valve, the other tools in the test string, such as circulating valves for example, have to be set to operate at a differential operating pressure greater than that of the tester valve. Typically, it is undesirable to increase the well annulus greater than about 3000 psi because of limits on the strength of the well casing. The present invention, therefore, allows the differential operating pressures of the various tools in the testing string to be spaced further apart, and also generally allows those pressures to be decreased. This improves both the safety and the reliability of operation of the entire testing string.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
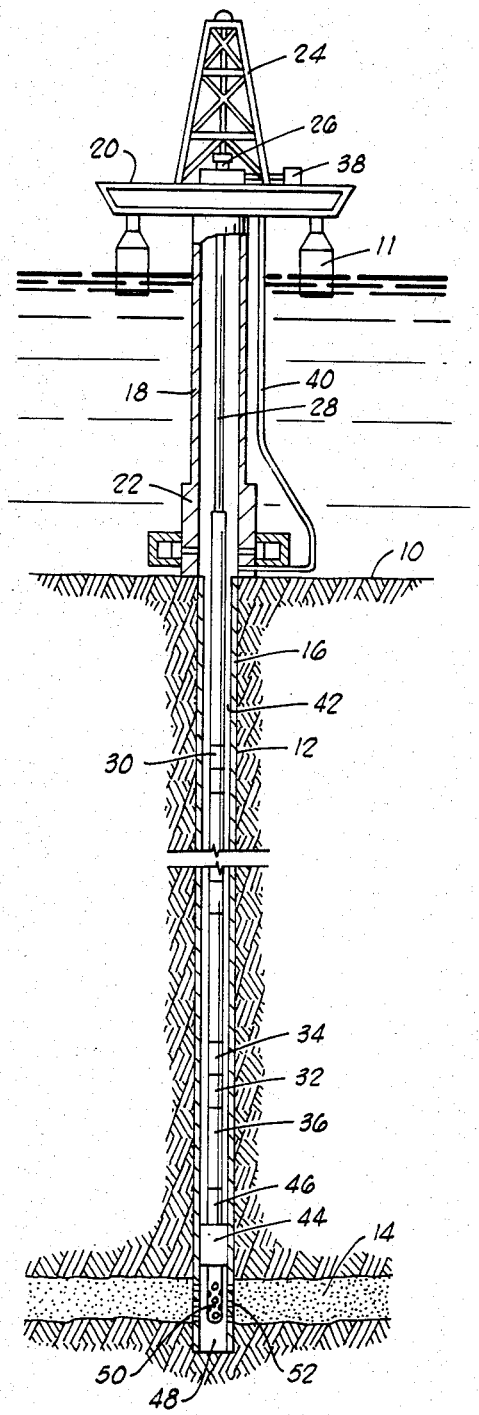
FIG. 1 is a schematic elevation view of an offshore well showing a well test string in place within the well bore.

Referring now to the drawings, and particularly to FIG. 1, the downhole tool of the present invention is shown in a testing string for use in an offshore oil or gas well.

In FIG. 1, a floating work station 11 is centered over a submerged oil or gas well located in the sea floor 10 having a bore hole 12 which extends from the sea floor 10 to a submerged formation 14 which is to be tested. The bore hole 12 is typically lined by a steel liner or casing 16 which is cemented into place.

A subsea conduit 18 extends from a deck 20 of the floating work station 11 into a well head installation 22. The floating work station 11 has a derrick 24 and hoisting apparatus 26 for raising and lowering tools to drill, test and complete the oil or gas well.

A testing string 28 is shown after it has been lowered into the bore hole 12 of the oil or gas well. The testing string 28 includes such tools as a slip joint 30 to compensate for the wave action of the floating work station 11 as the testing string 28 is being lowered into place, a tester valve 32 and a circulation valve 34. Also, a check valve assembly 36 may be located in the testing string 28 below the tester valve 32.

The tester valve 32, circulation valve 34, and check valve assembly 36, are operated by fluid annulus pressure exerted by a pump 38 located on the deck 20 of the floating work station 11. Pressure changes are transmitted by a pipe 40 to a well annulus 42 between the casing 16 and the testing string 28.

Annulus pressure in the well annulus 42 is isolated from the formation 14 to be tested by a packer 44 set in the well casing 16 just above the formation 14.

The testing string 28 also generally includes a tubing seal assembly 46 which stabs through a passageway through the production packer 44 forming a seal isolating an upper portion of the well annulus 42 above the packer 44 from an interior bore 48 of the well immediately adjacent the formation 14 and below the packet 44. The interior bore 48 may also be referred to as a lower portion of the well annulus 42 below the packer 44, it being understood that this lower portion 48 of the well annulus 42 is not necessarily annular in shape, but instead includes whatever portion of the well cavity there is below the packer 44.

A perforated tail piece 50, or other production tube, is located at the bottom end of the seal assembly 46 to allow formation fluids to flow from the formation 14 into a flow passage of the testing string 28. Formation fluid is admitted into the lower portion 48 of well annulus 42 through perforations 52 provided in the casing 16 adjacent the formation 14.

A testing string such as that illustrated may be used either to test formation flow from the formation 14, or treat the formation 14 by pumping liquids downward through the test string into the formation 14.

The present invention relates to low pressure responsive tools for use in such a test string.

The specific embodiments illustrated in the drawings and discussed below all relate to tester valves which would be located such as the tester valve 32 in the schematic illustration of FIG. 1.

The scope of the present invention, however, is such that it embodies more than just tester valves, and embodies any downhole tool apparatus which is operated in response to annulus pressure.

Thus the concepts about to be discussed can be utilized for tester valves, circulation valves, such as circulation valve 34 illustrated in FIG. 1, or also for example in sample chambers or the like which might be used with such a test string to trap a sample of the flowing fluid.

THE EMBODIMENT OF FIGS. 2–3

Referring now to FIGS. 2A–2E, an elevation half-section view is thereshown of a first embodiment of a tester valve of the present invention, which tester valve is generally designated by the numeral 32A. The tester valve 32A may generally be referred to as an annulus pressure responsive downhole tool apparatus 32A.

The tester valve 32A includes a tool housing generally designated by the numeral 54. The tool housing 54 includes an upper adaptor 56, a valve housing section 58, a first middle adaptor 60, a power housing section 62, a second middle adaptor 64, a cartridge housing section 66, and a lower adaptor 68.

An O-ring seal 70 is provided between upper adaptor 56 and valve housing section 58.

Valve housing section 58 and first middle adaptor 60 are joined at threaded connection 72 and a seal is provided therebetween by O-ring 74.

First middle adaptor 60 and power housing section 62 are joined together at threaded connection 76 and a seal is provided therebetween by O-ring 78.

Power housing section 62 and second middle adaptor 64 are joined together at threaded connection 80 and a seal is provided therebetween by double O-ring seal means 82.

Second middle adaptor 64 and cartridge housing section 66 are joined together at threaded connection 84 and a seal is provided therebetween by double O-ring means 86.

Cartridge housing 66 and lower adaptor 68 are joined together at threaded connection 88.

Disposed in the valve housing section 58 is a full opening ball valve means 90.

Figure 2A:
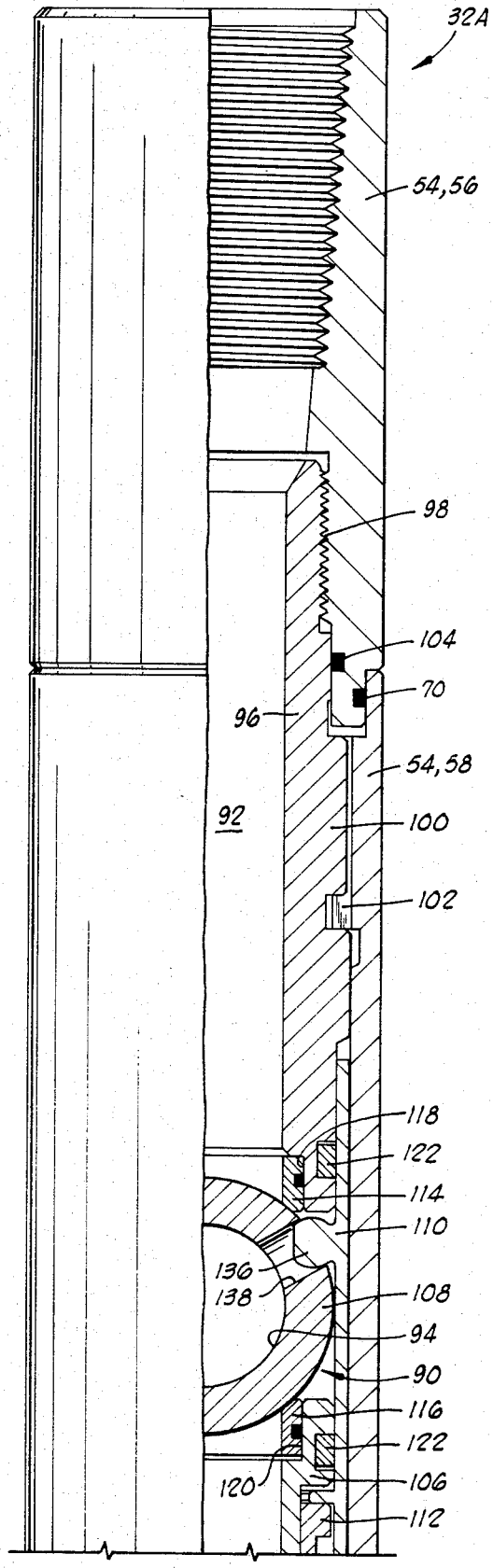
FIGS. 2A–2E comprise an elevation half-section view of a first embodiment of the downhole tool of the present invention.

The ball valve means 90 is illustrated in FIG. 2A in its first closed position closing a central bore 92 of the tester valve 32A. The ball valve means 90 may be rotated 90° relative to the housing 54 to an open position wherein a bore 94 of ball valve means 90 is aligned with central bore 92.

The ball valve means 90 includes an upper valve support 96 which is threadedly connected to upper adaptor 56 at threaded connection 98. Radially outwardly extending splines 100 of upper valve support 96 are engaged with radially inwardly extending splines 102 of valve section housing 58 to prevent relative rotation between those members. An O-ring seal 104 is provided between upper adaptor 56 and upper valve support 96.

Ball valve means 90 also includes a lower valve support 106, a ball 108, ball valve actuating arms 110 (only one of which is shown) and an actuating sleeve 112.

Upper and lower valve seats 114 and 116 are received within counterbores 118 and 120, respectively, of upper and lower valve supports 96 and 106. C-clamps 122 bias the upper and lower valve supports 96 and 106 toward each other so that the seats 114 and 116 are held in close engagement with the ball 108.

Referring now to FIG. 28, a ball valve actuating mandrel 124 has its upper end received within actuating sleeve 112. An upper end collar 126 is threadedly connected to ball valve actuating mandrel 124 at threaded connection 128. A lower end collar 130 is threadedly connected to the lower end of actuating sleeve 112 at threaded connection 132 so that upper end collar 126 is trapped between lower end collar 130 and a downward facing shoulder 134 of actuating sleeve 112.

Figure 2B:
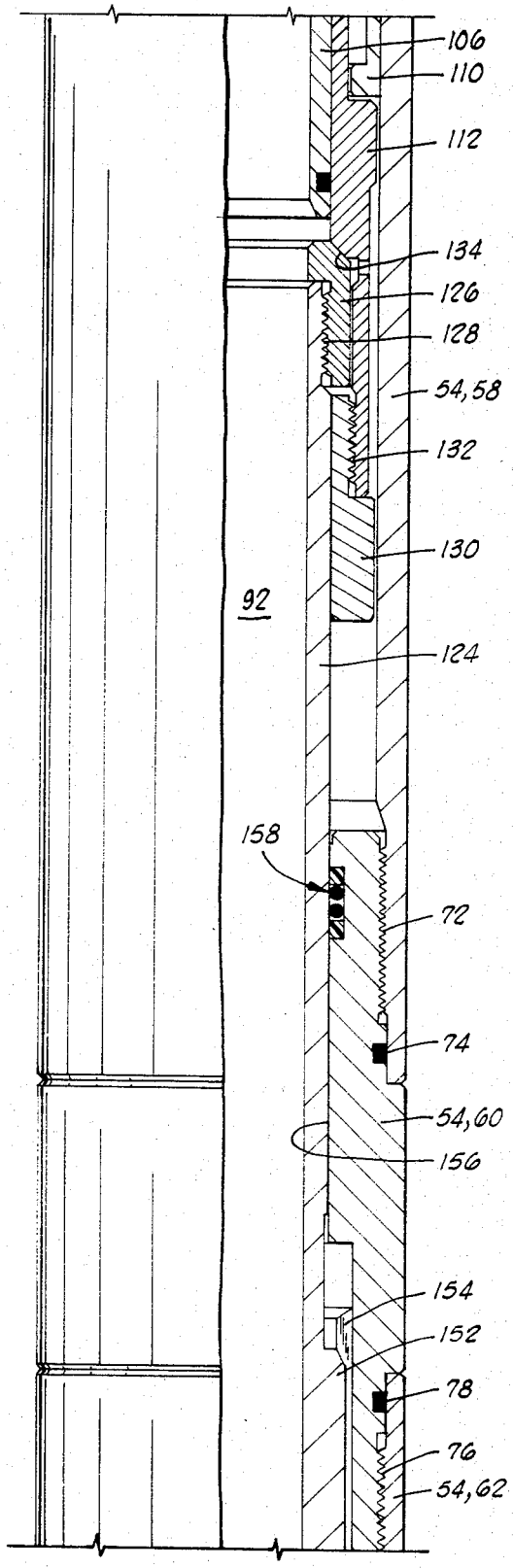

Thus, when ball valve actuating mandrel 124 is moved downward from the position illustrated in FIG. 2B, it pulls actuating sleeve 112 and ball valve actuating arms 110 downward relative to housing 54 so that a lug 136 of each ball valve actuating arm 110 which is received within a eccentric hole 138 of ball 108 causes the ball 108 to be rotated through an angle of 90° so that its bore 94 is aligned with the central bore 92 of the tester valve 32A.

Figure 2C:
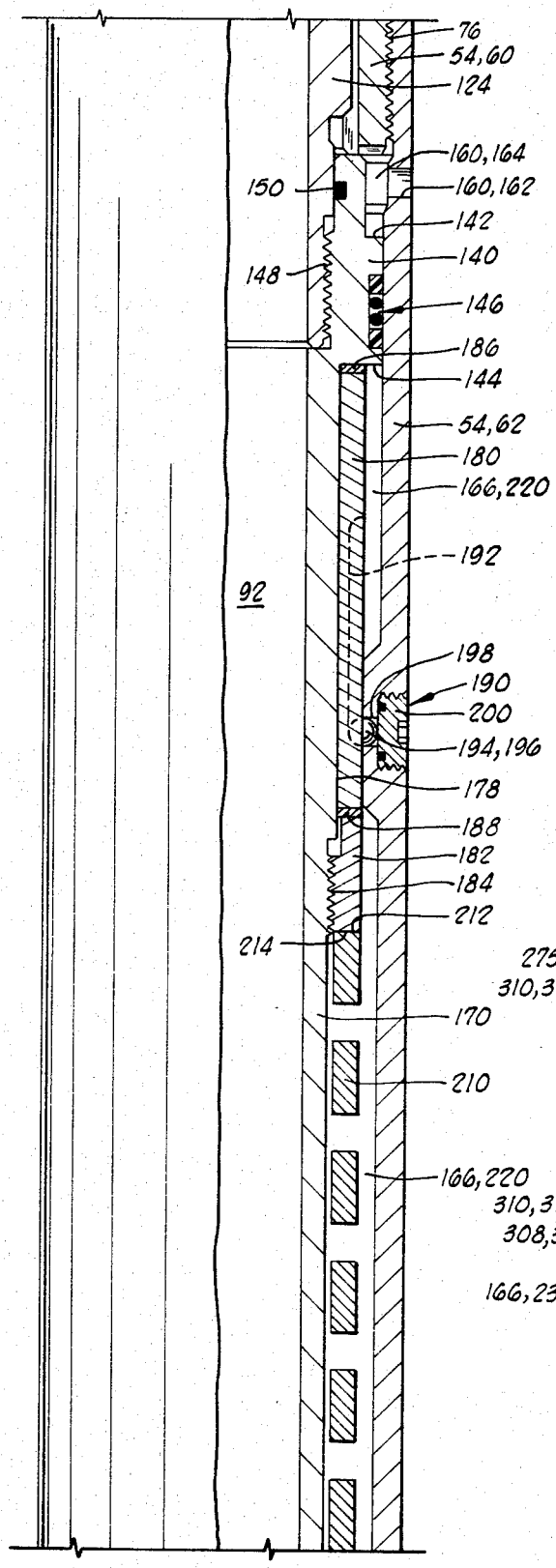

Referring now to FIG. 2C, a power piston 140 is slidably disposed in power housing section 62. Power piston 140 has a first side 142 and a second side 144. A double O-ring sliding seal means 146 is provided between power piston 140 and power housing section 62.

The ball valve actuating mandrel 124 is threadedly connected to power piston 140 at threaded connection 148 and O-ring seal 150 is provided therebetween.

Ball valve actuating mandrel 124 includes a plurality of radially outward extending splines 152 which engage radially inwardly extending splines 154 of first middle adaptor 60 to prevent relative rotation therebetween.

An intermediate portion of ball valve actuating mandrel 124, seen in FIG. 2B, is closely received within a bore 156 of first middle adaptor 60 and a double O-ring sliding seal means 158 is provided therebetween.

Disposed in the tester valve apparatus 32A is a first pressure conducting passage means 160 for communicating the well annulus 42 (see FIG. 1) with first side 142 of power piston 140. First pressure conducting passage means 160 includes a power port 162, and thus may be referred to as power passage means 160. First pressure conducting passage means 160 also includes an annular cavity 164 defined between power housing section 62 and the combined power piston 140 and ball valve actuating mandrel 124.

Also disposed in tester valve 32A is a second pressure conducting passage means 166 for communicating the well annulus 42 with the second side 142 of power piston 140. Second pressure conducting passage means 166 include a balancing port 168 (see FIG. 2E) disposed through cartridge housing section 66, and a plurality of other passages communicating balancing port 168 with second side 144 of power piston 140, which other passages are further described below.

Extending downward from power piston 140, is a guide mandrel means 170 which has its lower end 172 closely received in an upper counterbore 174 of second middle adaptor 64, with a double O-ring sliding seal means 176 being provided therebetween. In the embodiment illustrated in FIGS. 2C and 2D, the power piston 140 and the guide mandrel means 170 are integrally constructed, although they need not be so constructed.

Guide mandrel means 170 includes an enlarged diameter upper outer cylindrical surface 178 about which is rotatably disposed a ratchet sleeve 180.

A collar 182 is threadedly connected to guide mandrel means 170 at threaded connection 184 located just below enlarged diameter outer surface 178. Collar 182 holds ratchet sleeve 180 in place. Upper and lower annular bearings 186 and 188 engage the upper and lower ends of ratchet sleeve 180 to allow the same to rotate about guide mandrel 170.

Ratchet sleeve 180 is a part of a releasable holding means 190, which is operatively associated with the power piston 140, for selectively preventing the power piston 140 from returning to its first position illustrated in FIG. 2C, after it has moved downward to a second position corresponding to the open position of ball valve means 90.

The releasable holding means 190 includes a J-slot means 192 disposed in the outer surface of ratchet sleeve 180, and a lug means 194 connected to power housing section 62.

Figure 3:
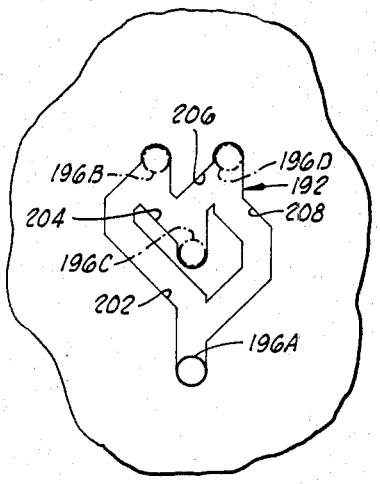
FIG. 3 is a layed out view of the J-slot arrangement disposed in sleeve 180 illustrated in FIG. 2C.

A layed out view of J-slot means 192, viewed looking from the outside in a radially inward direction, is shown in FIG. 3.

The lug means 194 includes a spherical ball lug 196 closely received in a radial bore 198 of power housing section 62 and held in place therein by a threaded retainer 200.

The J-slot means 192, with the lug means 194 received therein, provides a means for requiring that in order to return the power piston 140 to its first position illustrated in FIG. 2C, from a second lower position corresponding to the open position of ball valve means 90, the power piston 140 must be moved from its said second position to a partially returned intermediate holding position, then back to said second position and then back to said first position.

This operation is more clearly understood with reference to FIG. 3.

In FIG. 3, the ball lug 196 is illustrated in solid lines in position 196A corresponding to its position shown in FIG. 2C, wherein the ball lug 196 is located in a lower most extremity of J-slot means 192.

When power piston 140, the attached guide mandrel 170, and the ratchet sleeve 180 move longitudinally downward relative to power housing section 62 to open the ball valve means 90, the ball lug 196 first moves upward through a first leg 202 of J-slot means 192 to a position 196B illustrated in phantom lines. The position 196B corresponds to the second position of the power piston 140 and to the open position of the ball valve means 90.

In order to return the power piston 140 to its first position illustrated in FIG. 2C, the power piston 140 must be moved from its second position, corresponding to position 196B of ball lug 196 shown in FIG. 3, to an intermediate holding position wherein the ball lug 196 is in a position illustrated in phantom lines and designated by the numeral 196C in FIG. 3. To reach position 196C, the ball lug 196 moves through a second leg 204 of J-slot means 192.

Then to return the power piston 140 to its first position, it is necessary to once again move the power piston 140 downward relative to power housing section 62 so that the ball lug 196 moves through a third leg 206 of J-slot means 192 to a position illustrated in phantom lines in FIG. 3 as 196D. Then the power piston 140 is again moved upward relative to power housing section 62 so that the ball lug 196 moves from the position 196D downward through a fourth leg 208 of J-slot means 192 to the first position 196A.

Concentrically disposed about the lower portion of guide mandrel means 170 is a coil compression spring 210 which has its upper end 212 engaging a lower end surface 214 of collar 182 and which has its lower end 216 engaging an upper surface 218 of second middle adaptor 64.

Coil compression spring 210 may also be referred to as a resilient biasing means 210 operatively associated with power piston 140, for biasing power piston 140 toward its first position illustrated in FIG. 2C.

An annular cavity 220 is defined between guide mandrel means 170 and power housing section 62, and forms a portion of second pressure conducting passage means 166.

A lower inner mandrel 222 has its upper end closely received in a lower counterbore 224 of second middle adaptors 64. Lower inner mandrel 222 is threadedly connected to second middle adaptor 64 at threaded connection 226 and a double O-ring seal means 228 is provided therebetween.

A lower end portion of lower inner mandrel 222 is closely received within a bore 230 of lower adaptor 68 and a sliding O-ring seal 232 is provided therebetween.

An annular cavity 234 is defined between lower inner mandrel 222 and cartridge housing section 66 and defines a portion of second pressure conducting passage means 166.

A plurality of longitudinal bores 236 are disposed through the length of second middle adaptor 64 and provide fluid pressure communication between annular cavities 220 and 234.

Slidingly and sealingly disposed within a lower portion of annular cavity 234, and above balancing port 168, is an annular floating shoe 238. Radially inner and outer sliding O-ring seals 240 and 242 seal between annular floating shoe 238 and lower inner mandrel 222 and cartridge housing section 66 respectively.

A retarding means 244 is disposed in the annular cavity 234 of second pressure conducting passage means 166 for delaying communication of a sufficient portion of an increase in well annulus pressure to the second side 144 of power piston 140 for a sufficient time to allow a pressure differential from the first side 142 to the second side 144 of power piston 140 to move power piston 140 from its first position illustrated in FIG. 2C to a second position corresponding to the open position of ball valve means 90.

This retarding means 244 is also a means for allowing an additional portion of the increase in the well annulus pressure to be communicated to the second side 144 of power piston 140 after the the power piston 140 is moved to its said second position.

The retarding means 244 preferably includes an annular metering cartridge 246. The metering cartridge 246 is closely received about an enlarged intermediate outer cylindrical surface 248 of lower inner mandrel 222 and held in place thereon by a threaded collar 250 which engages the lower end of cartridge 246 and holds it tightly against a radially outward extending ledge 252 of lower inner mandrel 222. Annular O-ring seals 254 and 256 are provided between cartridge 246 and lower inner mandrel 222 and cartridge housing section 66, respectively.

Metering cartridge 246 includes one or more longitudinal bores 258 extending through the length thereof, which form a portion of second pressure conducting passage means 166.

Each of those longitudinal bores 258 includes an enlarged diameter portion 260 in which is received a fluid resistor 262 which includes a fluid flow restricting orifice.

Disposed in an upper portion of annular cavity 234 is a pressure relief cartridge 264 which is closely received about an upper outer cylindrical surface 266 of lower inner mandrel 222. Pressure relief cartridge 264 is held in place between a lower end 268 of second middle adaptor 64 and a longitudinally upward facing surface 270 of lower inner mandrel 222.

A pressure relief means 272 is disposed in pressure relief cartridge 264. Pressure relief means 272 is communicated with a first portion of the second pressure conducting passage means 166. The first portion of second pressure conducting passage means 166 is defined as that portion between the second side 144 of power piston 140 and the retarding means 244, and it includes annular cavity 220, the longitudinal bores 236 of second middle adaptor 64, cartridge passageways 274 and 310 through pressure relief cartridge 264, the upper part of annular cavity 234 above metering cartridge 246, and cartridge passageway 258 above fluid restrictor 262. This first portion of second pressure conducting passage means 266 may also be referred to as a low pressure zone communicated with second side 144 of power piston 140.

The pressure relief means 272 provides a means for relieving from said first portion of said second pressure conducting passage means 166, a volume of fluid sufficient to permit the power piston 140 to travel to its second position.

The first portion of said second pressure conducting passage means 166 is filled with a first fluid that is sufficiently incompressible such that the power piston 140 would be hydraulically blocked from traveling to its said second position unless said volume of said first fluid were relieved from said first portion of said second pressure conducting passage means 166 by said pressure relief means 272.

In the disclosed embodiment of the present invention, the first fluid is preferably silicone oil. While it is recognized that silicone oil has some compressibility, the volume of silicone oil contained in the first portion of second pressure conducting passage means 166 is not great enough to allow the power piston 140 to travel to its second position with the differential pressure contemplated by the present invention.

Silicone oil is used in the disclosed embodiment of the present invention in order to provide a sufficient compressibility of the oil in the annular cavity 234 below the pressure relief means 272 to allow the pressure relief means 272 to operate, as is further explained below.

Figure 2D:
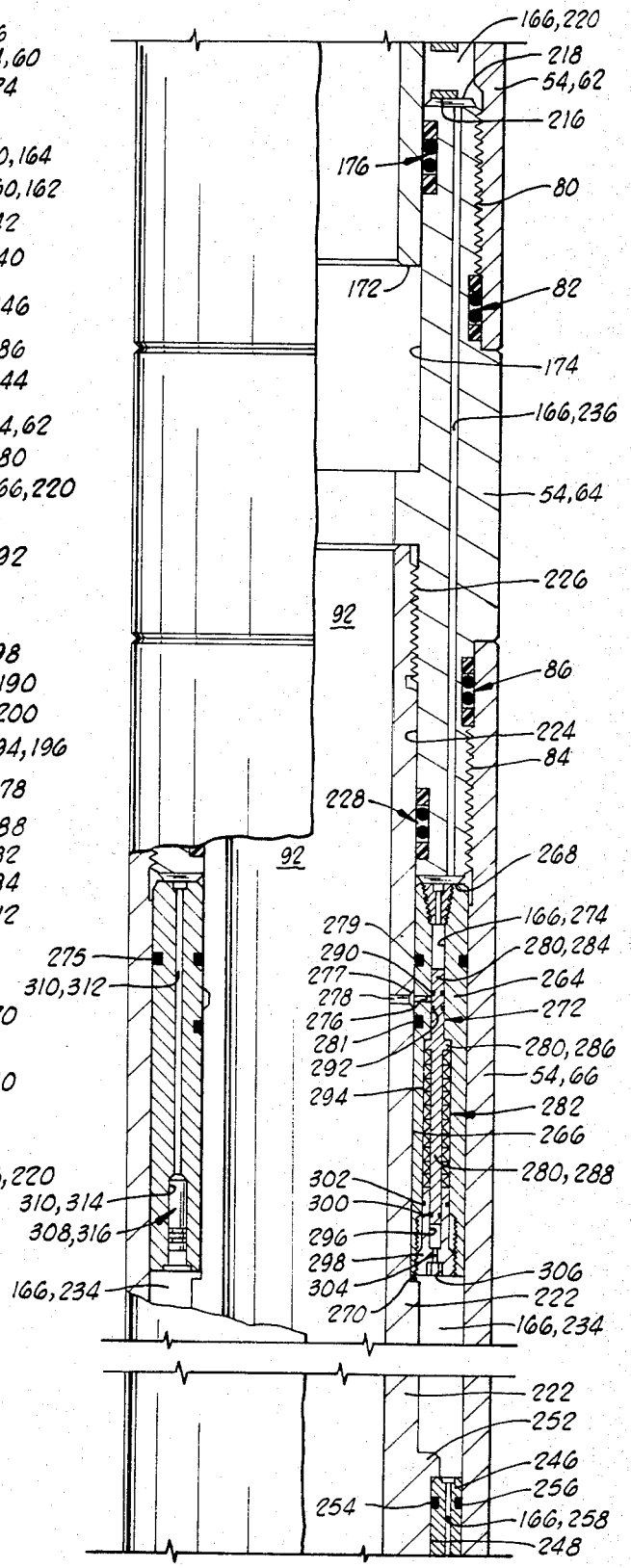

The pressure relief means 272, in the embodiment illustrated in FIG. 2D, includes a longitudinal bore or cartridge passageway 274 disposed in the cartridge 264. The cartridge 264 may also be referred to as a relief housing 264 for purposes of the description of pressure relief means 272.

A relief port 276 is disposed through the cartridge or relief housing 264 and communicates the first portion of the second pressure conducting passage means 166 with a fluid dump zone which is defined by the central bore 92 of tester valve 32A. The relief port 276 is actually communicated with a radial dump passage 278 of lower inner mandrel 222 which communicates central bore 92 of lower inner mandrel 222 with the relief port 276. Lower inner mandrel 222 has an outer circumferential groove 277 disposed therein which communicates with dump passage 278.

Cartridge 264 includes upper and lower inner O-ring seals 279 and 281, respectively, which seal above and below the radially outer circumferential groove 277, of lower inner mandrel 222. An O-ring seal 275 is disposed between the radially outer surface of pressure relief cartridge 264 and an inner cylindrical surface of cartridge housing section 66.

A pressure relief piston means 280 is slidably disposed in longitudinal bore 274 of pressure relief cartridge or relief housing 264. Pressure relief piston means 280 is movable between a first position illustrated in FIG. 2D wherein relief port 276 is closed and a second position, displaced longitudinally downward from the position illustrated in FIG. 2D, wherein relief port 276 is open.

The pressure relief piston means 280 divides the first portion of the second pressure conducting passage means 166, which first portion is defined as being that portion between the second side 144 of power piston 140 and the retarding means 244, into a first part between the power piston 140 and the relief piston means 280, and the second part between the relief piston means 280 and the retarding means 244.

A resilient relief piston biasing means 282, which is constructed from a stack of Belleville springs, provides a means for biasing the relief piston 280 toward its said first position. The biasing means 282 is constructed to allow the pressure relief piston 280 to open at a differential pressure of about 50–100 psi.

Pressure relief piston means 280 includes an upper cylindrical portion 284, a middle radially outward extending annular shoulder 286, and a lower reduced diameter cylindrical portion 288.

As previously mentioned, the upper portion 284 of pressure relief piston means 280 is slidably received within longitudinal bore 274. First and second O-ring seals 290 and 292 are disposed on upper cylindrical portion 284 and seal above and below relief port 276 when pressure relief piston means 280 is in its first position as illustrated in FIG. 2D closing pressure relief port 276.

The shoulder 286 of pressure relief piston means 280 is closely received within a counterbore portion 294 of longitudinal bore 274. The lower end of reduced diameter cylindrical portion 288 of pressure relief piston means 280 is closely received within a bore 296 of a threaded spring adjustment nut 298 and a sliding O-ring seal 300 is provided therebetween.

An O-ring seal 302 is provided between threaded spring adjustment nut 298 and the counterbore 294.

A reduced diameter longitudinal bore portion 304 is disposed through the lower end of threaded spring adjustment nut 298 and communicates with a hex socket opening 306 which in turn communicates with the annular cavity 234.

Also disposed in pressure relief cartridge 264 is a run-in balance means 308 for allowing well annulus pressure to sufficiently balance across power piston 140 as the tester valve 32A is run into the well defined by casing 16, so that a pressure differential from the first side 142 to the second side 144 of the power piston 140 is never sufficient to overcome the resilient biasing means 210 and prematurely move the power piston 140 to its second position as the tester valve 32A is being run into the well.

The pressure relief cartridge 264 has a second cartridge passageway 310, which may be referred to as a by-pass portion 310, of second pressure conducting passage means 166 disposed therethrough. The by-pass portion 310 includes longitudinal bore 312 and a lower counterbore 314 disposed through the length of pressure relief cartridge 264.

A one way check valve means 316 is disposed in counterbore 314 of by-pass portion 310 of second pressure conducting passage means 166 for allowing fluid flow and thus allowing pressure transmission in a first upward direction from the well annulus 42 through the by-pass portion 310 of the second pressure conducting passage means 166, then through the passages 236 and 220 to the second side 144 of power piston 140. Check valve means 316 prevents fluid flow in a downward reverse direction opposite of said first direction.

OPERATION OF THE EMBODIMENT OF FIGS. 2A–2E AND FIG. 3

The operation of the embodiment illustrated in FIGS. 2A–2E and FIG. 3 is as follows:

The tester valve 32A is initially in the position as illustrated in FIGS. 2A–2E with the power piston 140 in its upwardmost position relative to the power housing section 62 as illustrated in FIG. 2C, which first position corresponds to the closed position of the ball valve means 90 illustrated in FIG. 2A.

The tester valve 32A is made up in the testing string 28 in the position illustrated by the numeral 32 in FIG. 1, and is run down into the well defined by the well casing 16. Throughout this operation the coil compression spring 210 biases the power piston 140 upward toward its first position illustrated in FIG. 2C.

As the tester valve 32A is run down into the well, the hydrostatic pressure of the drilling mud and other fluid within the well continually increases as the tester valve 32 moves to lower and lower depths within the well. These increases in well annulus hydrostatic pressure are sufficiently balanced across the power piston 140 as the tester valve 32A is run into the well so that a pressure differential from the first side 142 to the second side 144 of power piston 140 is never sufficient to overcome the biasing means 210 and prematurely move the power piston 140 to its second position as the tester valve 32 is being run into the well.

This balancing is accomplished by means of the run-in balance means 308 which includes the one-way check valve 316. Thus, as the tester valve 32A is being run into the well, well annulus pressure is communicated to the second side 144 of power piston 140 through balancing port 168, then through annular cavity 234 by transmitting the same across floating shoe 238, then through fluid resistor 262 and longitudinal bore 258 of metering cartridge 246, then through annular cavity 234, then through check valve 318 and bypass portion 310 disposed in pressure relief cartridge 264, then through longitudinal bores 236 of second middle adaptor 64, then through annular cavity 220 which is directly communicated with the lower second side 144 of power piston 140.

With reference to FIG. 2C, it is noted that the ratchet sleeve 180 is somewhat loosely received between guide mandrel 170 and power housing section 62 and there are no seals provided therebetween so that fluid pressure within the lower portion of annular cavity 220 located below ratchet sleeve 180 is communicated to that portion of annular cavity 220 located above lug 196.

For this balancing of pressure across power piston 140 to be accomplished as the tester valve 32A is run into the well, the speed of run-in must be such that the increase in fluid pressure can be transmitted through the fluid resistor 262 of metering cartridge 246 quickly enough to prevent the downward pressure differential across power piston 140 from becoming great enough to overcome spring 210.

After the tester valve 32 reaches the position illustrated in FIG. 1, the packer means 44 is set within the well casing 16 to separate the well annulus 42 into an upper portion located above the packer means 44 and the lower portion 48 located below the packer means 44. It is noted that the power port 162 and the balancing port 168 of the first and second conducting passage means 160 and 166, respectively, are both communicated with the upper portion of the well annulus 42 located above the packer means 44, and that the central bore 92 which defines the flow passage 92 of the tester valve 32A is communicated with the lower portion 48 of the well annulus 42.

After the packer means 44 has been set within the well casing 16, an increase in annulus fluid pressure is applied to the upper portion of the well annulus 42 above the packer means 44.

This increase in annulus pressure is sufficiently great that if a pressure differential of that same value is placed across power piston 140 in a downward direction, it is sufficient to overcome the biasing force of coil compression spring 210.

This increase in annulus pressure is communicated to the first side 142 of power piston 140 through the first pressure conducting passage 160. That communication, of course, occurs substantially instantaneously as the increase in annulus pressure is applied to the well annulus 42.

The increase in annulus fluid pressure does not immediately reach the second side 144 of power piston 140, however.

The fluid restrictor 260 in metering cartridge 246 delays communication of a sufficient portion of the increase in annulus fluid pressure to the second side 144 of power piston 140 a sufficient time to allow a pressure differential from the first side 142 to the second side 144 of power piston 140 to move the power piston 140 to its second position corresponding to the position 196B of ball lug 196 illustrated in FIG. 3 and corresponding to an open position of ball valve means 90 wherein the bore 94 of ball 108 is aligned with and communicated with the central bore 92 of the tester valve 32A.

When this downward pressure differential is first applied across power piston 140, the power piston 140 cannot immediately move to its second position, because the first portion of the second pressure conducting passage means 166 between the second side 144 of power piston 140 and the retarding means 244, is filled with a relatively incompressible fluid.

When this pressure differential is first applied across power piston 140 it also creates a similar downward pressure differential across pressure relief piston means 280.

Since the volume of fluid displaced by the pressure relief piston means 280 in moving from its closed position to its open position is relatively small, the silicone oil contained in the annular cavity 234 has sufficient compressibility to allow the pressure relief piston means 280 to overcome the biasing force of the Belleville springs 282 and move to its open position.

Once the pressure relief piston means 280 is moved to its open position, the fluid located thereabove is relieved from the second pressure conducting passage means 166, as the power piston 140 moves from its first position to its second position. A volume of fluid sufficient to permit the power to travel to its second position flows from the second pressure conducting passage means 166 above pressure relief piston means 280 through the pressure relief port 276, through groove 277 and through dump passage 278 into the dump zone or central bore 92 of tester valve 32A.

After the power piston 140 is moved to its second position corresponding to the position 196B of lug 196 illustrated in FIG. 3 in phantom lines, an additional portion of the increase in annulus fluid pressure which was applied to the well annulus 42 is communicated to the second side 144 of power piston 140. This additional communication occurs by means of the fluid restrictor 262 of retarding means 244 which acts as a time delay and allows the entire increase in well annulus pressure to slowly be transmitted to the second side 144 of power piston 140. Thus after the increase in pressure in the annulus fluid in the well annulus 42 has been maintained for several minutes, substantially the entire increase has been communicated to the second side 144 of power piston 140. The time delay created by the fluid restrictor 262 of retarding means 244 is approximately two to three minutes.

As this entire increase in well annulus pressure is slowly communicated to the second side 144 of power piston 140, a point is reached where the downward pressure differential across power piston 140 is no longer sufficient to overcome coil compression spring 210, and at that point coil compression spring 210 moves the power piston 140 a short distance upward to an intermediate position wherein the lug 196 is in the position 196C shown in phantom lines in FIG. 3. This intermediate position 196C still corresponds to the open position of the ball valve means 90. During this upward movement of power piston 140 a small volume of silicone oil flows upward through check valve 316 so as to allow the power piston 140 to move upward and to replace a part of the fluid which was dumped into dump zone 92 during the initial downward movement of power piston 140.

When the lug 196 is in position 196C, the releasable holding means 190 releasably prevents the power piston 140 from returning to its first position.

To reclose the ball valve means 90 the following steps must be taken.

The annulus fluid pressure in well annulus 42 is decreased to essentially hydrostatic pressure and allowed to equalize across the power piston 140 when the power piston 140 is sitting in the position corresponding to position 196C of the lug 196.

An increase in annulus pressure is applied for a second time to the annulus fluid in the upper portion of well annulus 42. This again moves power piston 140 downward to its downwardmost position, and again fluid is relieved into the dump zone 92 by means of pressure relief means 280. This second increase in annulus pressure causes the lug 196 to move through the third leg 206 of J-slot means 192 to the position shown in phantom lines as 196D in FIG. 3. The position 196D in may be referred to as a released position.

Then a decrease in annulus fluid pressure is applied to the annulus fluid in the upper portion of the well annulus 42 above the packer means 44. This decrease in annulus fluid pressure is substantially immediately communicated to the first side 142 of power piston 142 and the resilient biasing means 210 then quickly returns the power piston 140 to its first position corresponding to the position 196A of lug 196 illustrated in FIG. 3.

This also moves the ball valve means 90 to its closed position closing the flow passage or central bore 92 of the tester valve 32.

As the piston 140 returns to its first position fluid is bypassed from the annular cavity 234 upwards through check valve means 316 and the bypass portion 310 of second pressure conducting passage means 166 to replace the fluid which was displaced when the power piston moved downward.

Thus it is seen that each time that the ball valve means 90 is opened and closed fluid is lost from the second pressure conducting passage means 166 to the dump zone 92.

The fluid lost from below the power piston 140 and above the pressure relief piston means 280 is replaced by fluid from the annular cavity 234 below the pressure relief piston means 280. As fluid flows upward from the annular cavity 234 through bypass portion 310, the annular floating shoe 238 (see FIG. 2E) moves upward to compensate for that fluid loss.

The number of times which the tester valve 32A can be cycled between the opened and closed positions of the ball valve means 90 is dependent upon the volume of fluid located in the annular cavity 234 above the annular floating shoe 238, which can be displaced by the annular floating shoe 238. When the annular floating shoe 238 reaches an upwardmost position engaging threaded collar 250 seen in FIG. 2E, the tester valve 32A can no longer be utilized without refilling annular cavity 234. In a preferred embodiment of the apparatus, the dimensions are such that the tester valve 32A can be moved between the opened and closed positions of ball valve means 90 approximately 17 times without refilling the annular cavity 234.

THE EMBODIMENTS OF FIGS. 4A–4E

An elevation half section view of a second embodiment of the present invention is shown in FIGS. 4A–4E and generally designated by the numeral 32B.

Those portions of tester valve 32B of FIGS. 4A–4E from the upper adaptor 56 down to approximately the level of power piston 140 are substantially identical to the analogous portions of the tester valve 32A of FIGS. 2A–2E. Identical or substantially similar parts of the tester valves 32A and 32B are designated with identical numerals, and the detailed description of those upper portions of tester valve 32A are applicable to the tester valve 32B and will not be repeated.

Some portions of the housing 54 of tester valve 32B are modified as compared to tester valve 32A. Thus, housing 54 includes upper adaptor 56, valve housing section 58, and first middle adaptor 60. Valve housing 54 of valve tester 32B also includes a power housing section 400, a second middle adaptor 402, a metering cartridge housing section 404, and a lower adaptor 406.

The upper end of power housing section 400 is threadedly connected to first middle adaptor 60 at threaded connection 408.

Second middle adaptor 402 is threadedly connected to the lower end of power housing section 400 at threaded connection 410 and a seal is provided therebetween by O-ring seal 412.

Metering cartridge housing section 404 is threadedly connected to second middle adaptor 402 at threaded connection 414 and an O-ring seal is provided therebetween by O-ring 416.

Lower adaptor 406 is threadedly connected to metering cartridge housing section 404 at threaded connection 418.

Figure 4A:
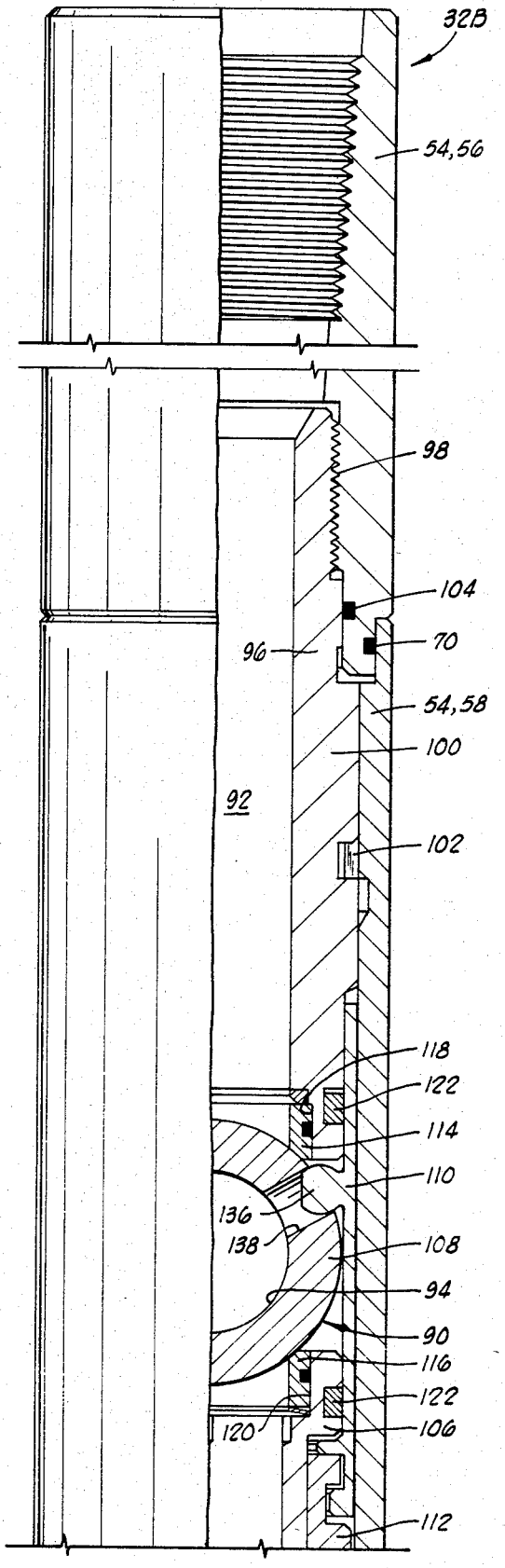
FIGS. 4A–4E comprise an elevation half-section view of a second embodiment of the present invention.
Figure 4B:
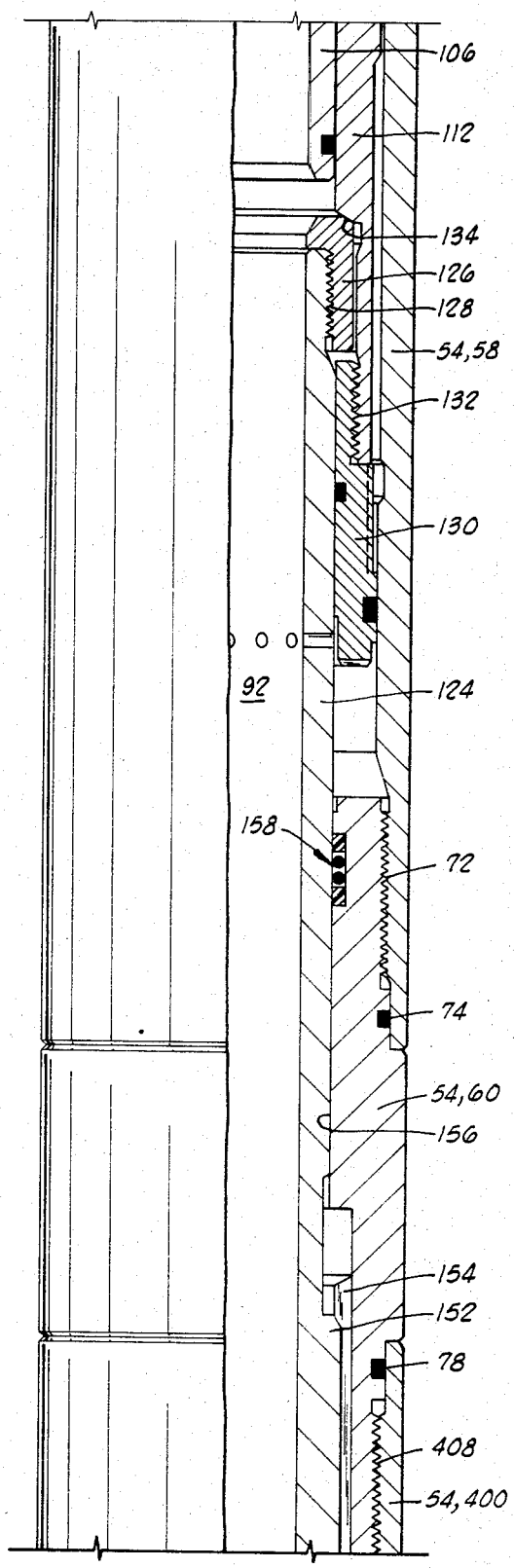
Figure 4C:
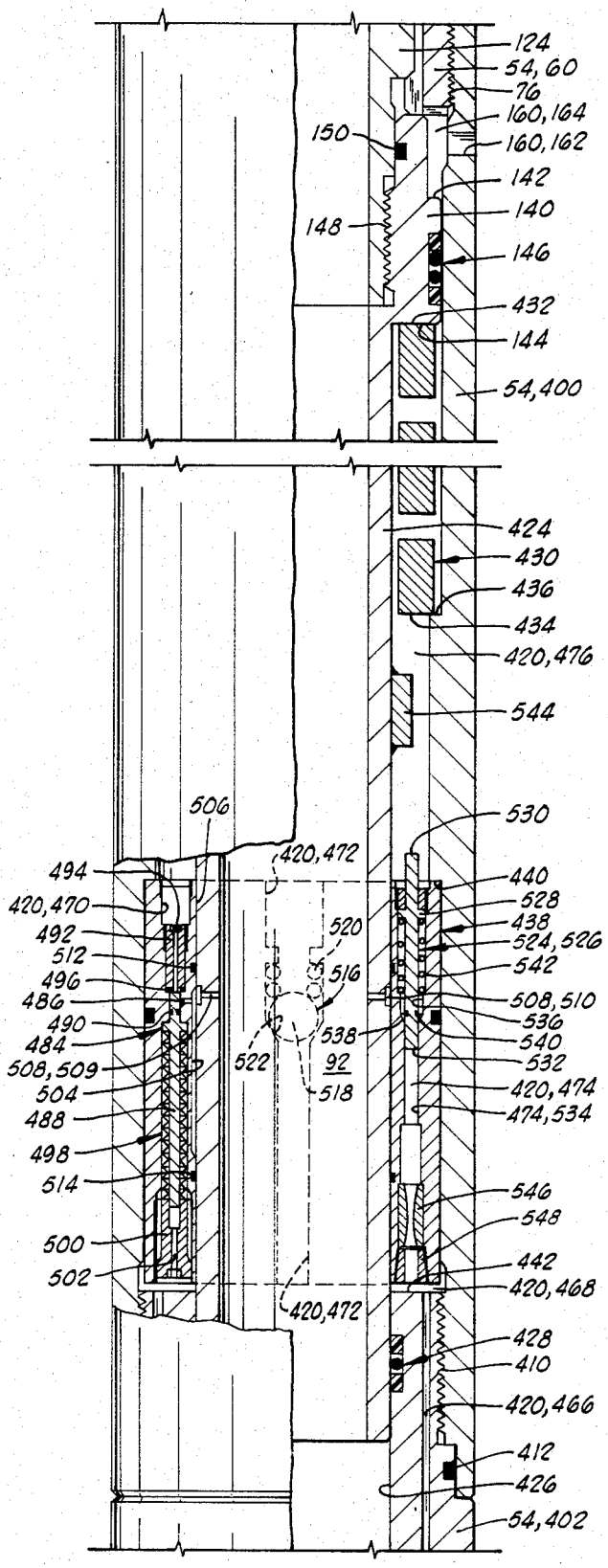

The first pressure conducting passage means 160 shown in FIG. 4C is substantially the same as first pressure conducting passage means 160 of tester valve 32A shown in FIG. 2C.

A second pressure conducting passage means 420 communicates a balancing port 422 (see FIG. 4E) with second side 144 of power piston 140.

Extending downward from power piston 140 is a guide mandrel means 424 which has its lower end closely and slidably received within an upper counterbore 426 of first middle adaptor 402. A sliding seal is provided therebetween by O-ring 428.

A resilient biasing means 430, is operatively associated with power piston 140, for biasing the power piston 140 upward towards its first position illustrated in FIG. 4C. The resilient biasing means 430 in the embodiment illustrated is a coil compression spring 430 having an upper end 432 engaging the second side 144 of power piston 140 and having its lower end 434 engaging an upward facing radially inward extending shoulder 436 of power housing section 400.

A pressure relief cartridge 438 is concentrically disposed outside of guide mandrel 424 and inside of power housing section 400, and is held longitudinally in place relative to power housing section 400 between a downward facing radially inward extending annular shoulder 440 of power housing section 400 and an upper end 442 of second middle adaptor 402.

Figure 4D:
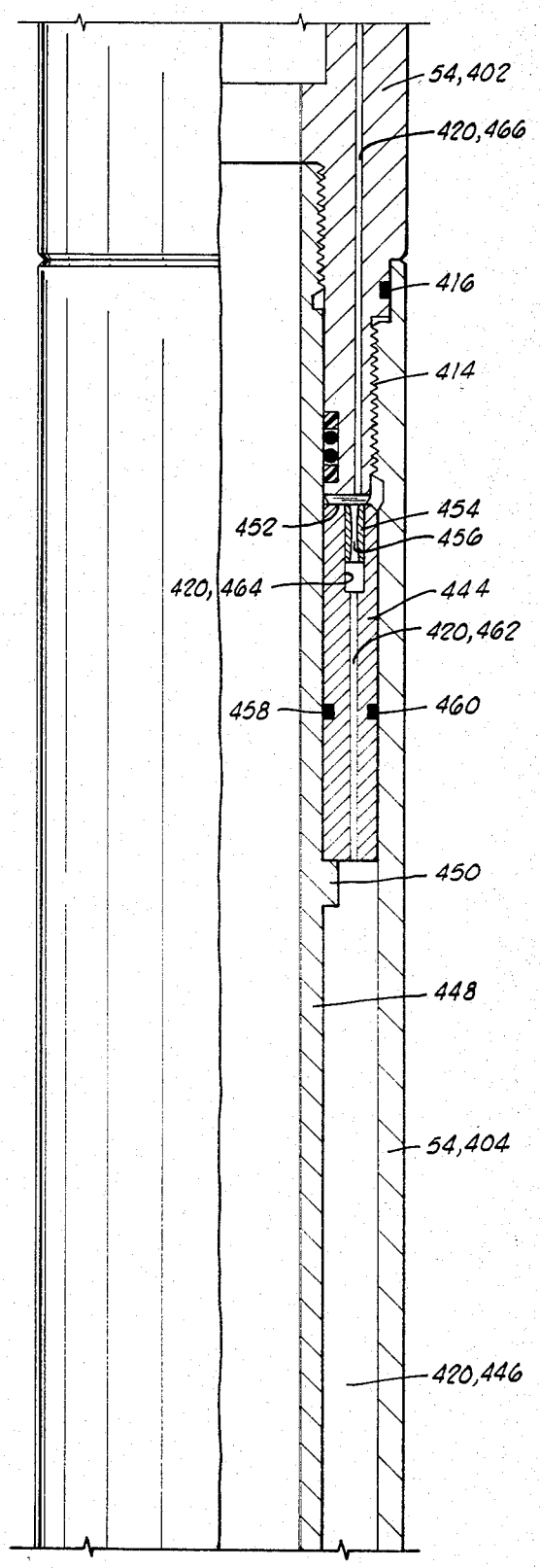
Figure 4E:
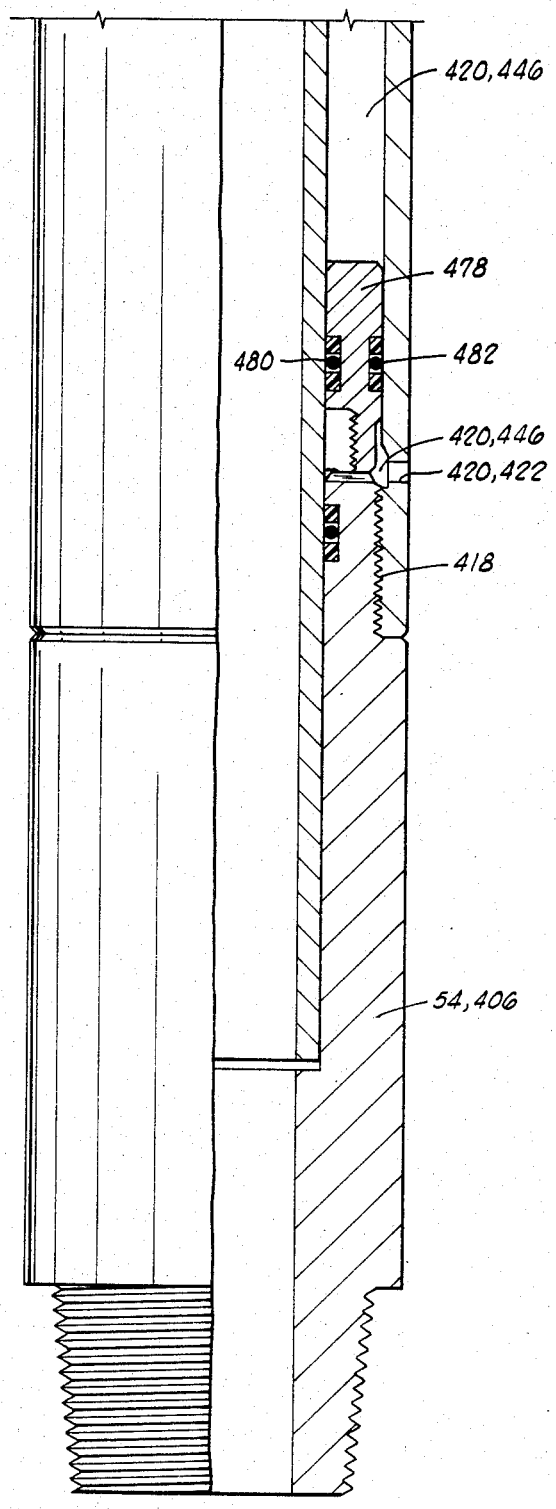

Referring now to FIG. 4D, a metering cartridge retarding means 444 is located in an annular cavity 446 defined between a lower inner mandrel 448 and metering cartridge housing section 404. Metering cartridge 444 is held longitudinally in place between a radially outward extending ledge 450 of lower inner mandrel 448 and a lower end 452 of second middle adaptor 402.

Figure 2E:
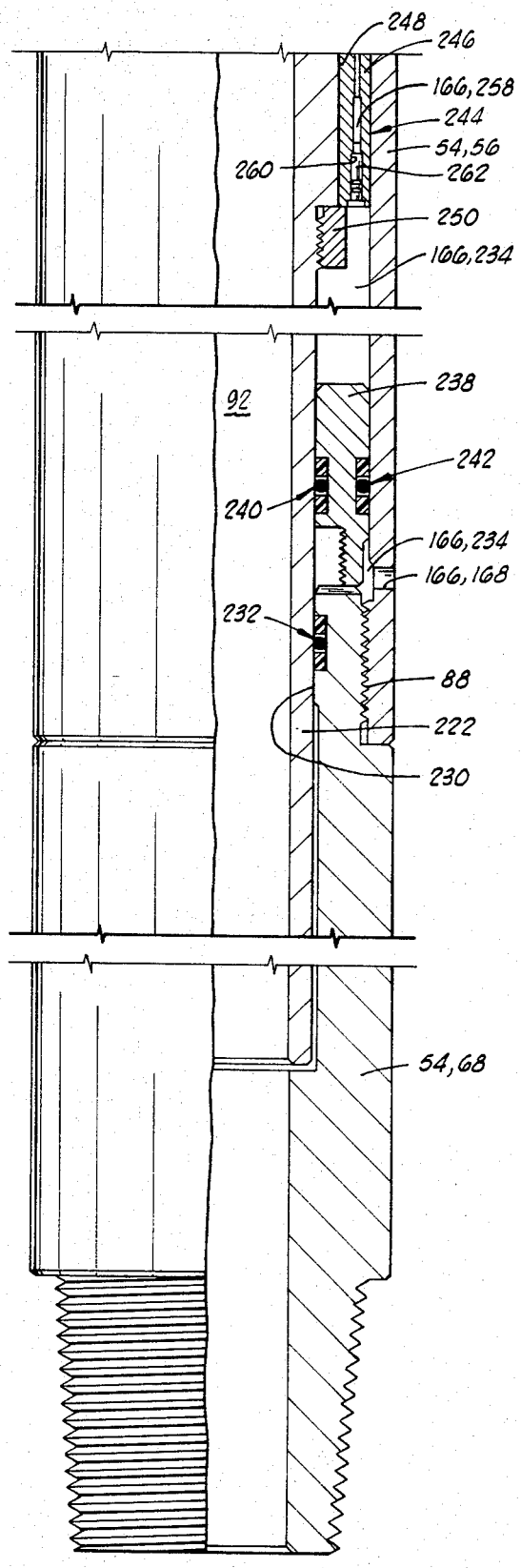

Although the metering cartridge 444 is illustrated somewhat differently from the metering cartridge 246 of tester valve 32A illustrated in FIGS. 2D and 2E, it functions in substantially the same way. A flow restrictor 454 is located therein and includes a reduced diameter flow passage 456 shown in cross section therein. Inner and outer O-ring seals 458 and 460 seal between metering cartridge 444 and lower inner mandrel 448 and metering cartridge housing section 404, respectively. The metering cartridge 444 may generally be described as a retarding means 444 disposed in the second pressure conducting passage means 420 for delaying communication of a sufficient portion of an increase in the well annulus fluid pressure to the second side 144 of power piston 140 for a sufficient time to allow a pressure differential from the first side 142 to the second side 144 of power piston 140 to move power piston 140 from a first position to a second position relative to the housing 54.

The second pressure conducting passage means 420 of the tester valve 32B of FIGS. 4A–4E includes, beginning at the lower end, balancing port 422, annular cavity 446, longitudinal bore 462 and counterbore 464 of metering cartridge 444, longitudinal bore 466 of second middle adaptor 402, a short annular cavity 468 defined between guide mandrel means 424 and power housing section 400, first, second and third cartridge passages 470, 472 and 474 disposed through the length of pressure relief cartridge 438, and annular cavity 476 defined between guide mandrel means 424 and power housing section 400.

An annular floating shoe 478 is disposed within annular cavity 446 above balancing port 422 and has annular inner and outer sliding seals 480 and 482.

The major difference between tester valve 32B of FIGS. 4A–4E, and tester valve 32A of FIGS. 2A–2E, lies in the fact that the pressure relief cartridge has been very greatly modified, and the J-slot and lug type of releasable holding means 190 of FIG. 2C has been eliminated and replaced by a very different type of releasable holding means which operates based upon a hydraulic pressure differential across the power piston 140.

Referring now to FIG. 4C, these changes will be described in greater detail.

A pressure relief means 484 is disposed in first cartridge passage 470 for relieving from a first portion of the second pressure conducting passage means 420 a volume of fluid sufficient to permit power piston 140 to travel to its second position. This first portion of the second pressure conducting passage means 420 is that portion between the second side 144 of power piston 140 and the retarding means 444. As in the embodiment 32A of FIGS. 2A–2E, the second pressure conducting passage means 420 throughout its length between the second side 144 of power piston 140 and the annular floating shoe 478 is filled with a hydraulic fluid such as silicone oil.

This silicone oil is sufficiently incompressible such that the volume thereof located between the power piston 140 and the pressure relief means 484 would hydraulically block the power piston 140 from traveling to its second position unless a volume of this fluid equal to the displacement of power piston 140 were relieved from the first portion of the second pressure conducting passage means 420 by the pressure relief means 484.

The pressure relief means 484 shown in FIG. 4C is constructed very similar to and operates in substantially the same manner as the pressure relief means 272 shown in FIG. 2D.

In that regard, the pressure relief cartridge 438 may also be referred to as a relief housing 438. A relief port 486 is disposed through the relief housing 438 and communicates the first portion of the second pressure conducting passage means 420 with the fluid dump zone 92 which is also the central bore of the tester valve 32B.

A pressure relief piston means 488 is slidably disposed in first cartridge passageway 470 and is movable between a first position illustrated in FIG. 4C wherein relief port 486 is closed, and a second position wherein the pressure relief piston 488 is displaced downward relative to relief housing 438 from the position illustrated in FIG. 4C, so that the relief port 486 is opened.

When pressure relief piston means 488 is in its closed position as illustrated in FIG. 4C, an O-ring seal 490 disposed in the outer surface of an upper end portion of pressure relief piston means 488 seals within the first cartridge passageway 470 below relief port 486.

Disposed within first cartridge passageway 470 above pressure relief piston means 488 is a threaded insert 492 having a longitudinal bore 494 extending therethrough. The lowermost end portion of insert 492 is reduced in diameter and has an O-ring seal 496 disposed thereabout.

An uppermost extremity of pressure relief piston 488 has a knife edge defined thereon which engages O-ring seal 496 to provide a seal above the relief port 486.

A resilient relief piston biasing means 498, comprised of a stack of Belleville springs, is disposed about a lower cylindrical portion of pressure relief piston means 488 and serves to bias pressure relief piston means 488 towards its closed position.

A lower threaded insert 500 engages the lower end of the stack of Belleville springs 498 and may be threadedly adjusted to adjust the compression of the stack of springs 498. A longitudinal bore 502 is disposed through lower threaded insert 500.

The relief port 486 communicates with a longitudinal groove 504 disposed in an inner cylindrical surface 506 of pressure relief cartridge 438.

The guide mandrel means 424 has a dump passage 508 disposed therethrough and communicated with the fluid dump zone 92. Dump passage 508 includes a plurality of radial ports 509 and an outer annular groove 510 disposed in guide mandrel means 424 and communicated with the ports 509.

The longitudinal groove 504 of pressure relief cartridge 438 is communicated with annular groove 510 of dump passage 508 throughout the travel of power piston 140 and its attached guide mandrel means 424.

Upper and lower O-ring seals 512 and 514 seal between pressure relief cartridge 438 and guide mandrel 424 above and below the longitudinal groove 504.

A back pressure check valve means 516 is disposed in second cartridge passage 472 for preventing communication of a sufficient portion of an increase in well annulus pressure to the second side 144 of power piston 140 so that so long as said increase in well annulus pressure is maintained on said first side 142 of power piston 140, a sufficient pressure differential is maintained from said first side 142 to the second side 144 of power piston 140 to prevent the resilient biasing means 430 from returning the power piston 140 to its first position.

This back pressure check valve means 516, which is only schematically illustrated in FIG. 4C, includes a ball 518 which is resiliently biased by a coil compression spring 520 downward against a valve seat 522.

The back pressure check valve means 516 is designed such that it prevents a substantial portion of any increase in the well annulus pressure from ever reaching the second side 144 of power piston 140, so that when an increase in well annulus pressure is applied to the well annulus, there is always a downward pressure differential across power piston 140 so long as that increase in well annulus pressure is maintained on the well annulus. This downward pressure differential which is maintained on the power piston 140 is sufficiently great that it always is greater than the upward biasing force of biasing means 430 whereby the power piston 140 may be said to be releasably held in its second position so long as the increase in well annulus pressure is maintained on the well annulus.

For example, if the upward biasing force of spring 430 is equivalent to an upward pressure differential of 400 psi across the power piston 140, then the back pressure check valve means 516 would be designed to open at a 600 psi pressure differential so that the fluid pressure in annular cavity 476 is always at least 600 psi less than the annulus fluid pressure so long as an increase in annulus fluid pressure of greater than 600 psi which was applied to the annulus is maintained on the annulus fluid.

Thus, the back pressure check valve means may be said to be a releasable holding means 516 releasably preventing the power piston 140 from returning to its first position.

A run-in balance means 524 is disposed in third cartridge passage 474 for allowing well annulus pressure to sufficiently balance across power piston 140 as the tester valve 32B is run into the well so that a pressure differential from the first side 142 to the second side 144 of power piston 140 is never sufficient to overcome the resilient biasing means 430 and prematurely move the power piston 140 to its second position as the tester valve 32B is run into the well.

The run-in balance means 524 includes a balance valve means 526 movable relative to pressure relief cartridge 438 between an open position illustrated in FIG. 4C, wherein fluid may flow through third cartridge passage 474, and a closed position, displaced downwardly slightly relative to pressure relief cartridge 438 from the position illustrated in FIG. 4C, to a closed position wherein fluid flow through the third cartridge passage 474 is prevented.

Balance valve means 526 is substantially cylindrical in shape and has a radially outward extending ledge 528 defined on an intermediate part thereof.

A first end 530 of balance valve means 526 extends upward out of third cartridge passage 474 toward the power piston 140.

A second end 532 of balance valve means 526 is closely received with a reduced inner diameter portion 534 of third cartridge passage 474.

Third cartridge passage 474 includes an enlarged inner diameter portion 536 located above reduced inner diameter portion 534, and the inner surfaces 534 and 536 are joined by a tapered seating surface 538.

When balance valve means 526 is in its open position as illustrated in FIG. 4C, an O-ring seal 540 disposed about a lower portion of balance valve means 528 is located above tapered seating surface 538 out of engagement therewith, so that fluid may flow through the relative small clearances between balance valve means 526 and the reduced diameter portion 534 of third cartridge passage 474.

Disposed about balance valve means 526 below the ledge 528 thereof is a coil compression balance valve biasing spring 542 which biases balance valve means 526 upward toward its open position.

An actuating lug 544 is attached to the guide mandrel 424, which may also be referred to in the present embodiment as an operating mandrel 424, for engaging the first end 530 of balance valve means 526 and for moving the balance valve means 526 to its closed position wherein the O-ring seal 540 sealingly engages the tapered seating surface 538 as the power piston 140 moves to its second position.

Actuating lug 544 provides an actuating means, operatively associated with power piston 140, for mechanically moving the balance valve means 526 to its closed position as the power piston 140 moves to its second position.

In the lower end of third cartridge passage 474, a fluid restrictor 546 is held in place by a lower threaded insert 548. Fluid restrictor 546 protects balance valve means 526 from excessive pressure differentials which might damage it.

The third cartridge passage 474 may also generally be referred to as a bypass portion 474 of the second pressure conducting passage means 420, which bypass portion bypasses the pressure relief means 484.

As is further explained below in the description of the operation of the tester valve 32B, the balance valve means 526 may also be referred to as a seal valve means 526, disposed in the second pressure conducting passage means 420, for preventing communication of any further portion of the increase in well annulus pressure to the second side 144 of power piston 140 after the back pressure check valve means 516 has finally closed subsequent to the power piston 140 reaching its second position. Thus, the actuating lug 544 may also be referred to as an actuating means 544, operatively associated with the power piston 140, for mechanically closing the seal valve means 526 when the power piston 140 moves to its second position.

Further, the retarding means 444 may also be further characterized as being a means for allowing a first additional portion of the increase in well annulus pressure to be communicated to the second side 144 of the power piston 140 after the power piston 140 is moved to its second position.

OPERATION OF THE EMBODIMENT OF FIGS. 4A–4E

The operation of the tester valve 32B of FIGS. 4A–4E is generally as follows.

The tester valve 32B is initially oriented as illustrated in FIGS. 4A–4E and is made up with the test string 28 in the position designated by the numeral 32 in FIG. 1.

The tester valve 32B is then run down into the well defined by well casing 16 with the ball valve means 90 in its closed position closing the central bore flow passage 92 of the tester valve 32B, and with the power piston 140 in its first position as illustrated in FIG. 4C.

The coil compression spring 430 resiliently biases the power piston 140 towards its first position.

As the tester valve 32B is run into the well, the increase in hydrostatic pressure of the well annulus fluid with increasing depth is sufficiently balanced across the power piston 140 so that a pressure differential from the first side 142 to the second side 144 of power piston 140 is never sufficient to overcome the resilient biasing means 430 and prematurely move the power piston 140 to its second position as the tester valve 32B is being run into the well.

This balancing of well annulus hydrostatic pressure as the tester valve 32B is run into the well is accomplished by the balance valve means 526.

The increase in hydrostatic well annular pressure is communicated, with a time delay due to the retarding means 444, to the lower end of third cartridge passage 474, and then through the slight clearance between the lower end of balance valve means 526 and the reduced diameter internal bore portion 534 of third cartridge passage 474 upward to annular cavity 476 and the second side 144 of power piston 140. Sufficient fluid flow can be obtained through these small clearances because the only fluid flow which is required in order to balance the increasing hydrostatic pressure across the power piston 140, is the very slight flow necessary to account for the slight compressibility of the silicone oil which is trapped between the second side 144 of power piston 140 and the pressure balance cartridge 438.

Once the tester valve 32B is in the position illustrated in FIG. 1, the packer means 44 is set to separate the well annulus 42 into an upper portion above the packer means 44 and the lower portion 48 below the packer means 44. The power port 162 and balancing port 422, and accordingly the first and second pressure conducting passage means 160 and 420, respectively, are communicated with the upper portion of the well annulus 42 above the packer means 44. The flow passage central bore 92 of the tester valve 32B is communicated with the lower portion 48 of the well annulus 42 below the packer means 44.

After setting the packer means, an increase in annulus fluid pressure is applied to the annulus fluid in the upper portion of the well annulus 42 above the packer means 44.

This increase in annulus pressure is substantially instantaneously communicated to the first side 142 of power piston 140 through the first pressure conducting passage means 160.

The fluid flow restrictor 454 of retarding means 444 delays communication of a sufficient portion of this increase in annulus fluid pressure to the second side 144 of power piston 140 for a sufficient time to allow a pressure differential from first side 142 to second side 144 of power piston 140 to move the power piston 140 downward to its second position corresponding to an open position of ball valve means 90.

Initially, the power piston 140 is hydraulically blocked from moving downward by the fluid trapped between the power piston 140 and the pressure relief cartridge 438.

The downward pressure differential across pressure relief piston means 488, however, quickly causes pressure relief piston 488 to move downward breaking the seal with O-ring 496 so as to open the pressure relief means 484 and allow fluid trapped below the power piston 140 to be relieved through the relief port 486 and the dump passage 508 into the dump zone 92. This fluid is continuously relieved to the dump zone 92 as the power piston 140 moves from its first position to its second position. The volume of fluid relieved through the pressure relief means 484 is equal to a volume of fluid displaced by the power piston 140 as it travels from its first position to its second position.

As the power piston 140 moves from its first position to its second position it rotates the ball valve means 90 to an open position wherein the bore 94 thereof is vertically aligned with the central bore 92 of tester valve 32B.

In the last thirty to forty thousandths of an inch of movement of the power piston 140, the actuating lug 544 engages the upper end 530 of balance valve and seal valve means 526 to thereby mechanically close the balance valve and seal valve means 526 as the power piston 140 moves to its second position.

This closing of the balance valve and seal valve means 526 prevents communication of any further portion of the increase in well annulus pressure to the second side 144 of power piston 140 after the back pressure check valve means 516 has finally closed subsequent to the power piston 140 reaching its second position.

With regard to the movement of the back pressure check valve means 516, it of course is in a closed position while the power piston 140 is moving downward from its first position to its second position, because there is a downward pressure differential across the ball valve means 516.

The downward movement of the power piston 140 occurs very rapidly, in a matter of just a few seconds or less, and thus after the power piston 140 reaches its lowermost position wherein the actuating lug 544 mechanically holds the balance valve and seal valve means 526 closed, there is still a substantial amount of the increase in well annulus pressure which has not yet been communicated through the retarding means 444. Thus, as the increase in annulus fluid pressure continues to be communicated to the lower side of pressure relief cartridge 438 through the retarding means 444, the pressure in second pressure conducting passage means 420 below pressure relief cartridge 438 will ultimately exceed the pressure in annular cavity 476 above pressure relief cartridge 438.

When the pressure below pressure relief cartridge 438 exceeds the pressure above pressure relief cartridge 438 by a value greater than the opening value of the back pressure check valve means 516, the back pressure check valve means 516 will open so as to control the pressure in the annular cavity 476 above the pressure relief cartridge 438.

Thus, ultimately several minutes after the increase in annulus pressure has been applied to the well annulus 42, and so long as the increase in annulus pressure is maintained on the well annulus, a situation will be reached wherein the pressure relief valve means 484 has returned to its closed position as illustrated in FIG. 4C, the balance valve and seal valve means 526 is mechanically held in a closed position by actuating lug 544 engaging the upper end 530 thereof, and the back pressure check valve means 516 is finally closed, trapping a pressure in the annular cavity 476 which is equal to the well annulus pressure minus the operating pressure of the back pressure check valve means 516.

Thus, at this equilibrium state, a downward pressure differential is maintained across power piston 140 which is equal to the operating pressure of the back pressure check valve means 516. This operating pressure is designed such that the downward pressure differential across power piston 140 will always be greater than the upward force being exerted by resilient biasing means 430, so long as the increase in annulus pressure is maintained on the well annulus.

Then, in order to reclose the ball valve means 90, the increase in well annulus pressure is rapidly dropped, thus allowing the resilient biasing means 430 to move the power piston 140 upward and return it to its first position.

Upon this upward movement of power piston 140, most of the oil flow, which is necessary from the second pressure conducting passage means 420 below pressure relief cartridge 438 upward through pressure relief cartridge 438 to the annular cavity 476 to replace the fluid which was lost during the downward movement of the power piston 140, flows upward through the second cartridge passage 472 past the back pressure check valve means 516.

Also, the initial thirty to forty thousandths inch movement upwardly of power piston 140 allows the seal of O-ring 540 with tapered seating surface 538 to be broken. This seal is broken due to the resilient balance valve compression spring 544 biasing the balance valve 526 upward. The compressibility of the silicone oil located in second pressure conducting passage means 420 below the balance valve means 526 allows this initial thirty to forty thousandths inch movement even if there has not yet been any upward fluid flow through the second cartridge passage 472.

Once the upward pressure differential across pressure relief cartridge 438 decreases to below the operating pressure of back pressure check valve means 516, the back pressure check valve means 516 will close and the remaining upward oil flow necessary to allow the power piston 140 to return all the way upward to its first position is provided by flow through the third cartridge passage 474 pass the balance valve means 526 in the manner previously described.

THE EMBODIMENT OF FIGS. 5A–5G

Referring now to FIGS. 5A–5G, an elevation half section view is thereshown of a third embodiment of the tester valve of the present invention which is generally designated by the numeral 32C.

Those portions of tester valve 32C from the upper adaptor 56 down to about the level of power piston 140 are identical or substantially similar to the analogous portions of the tester valve 32A shown in FIGS. 2A–2C. Those identical or substantially components are designated by the same numerals utilized in FIGS. 2A–2C, and the detailed description thereof will not be repeated.

Figure 5A:
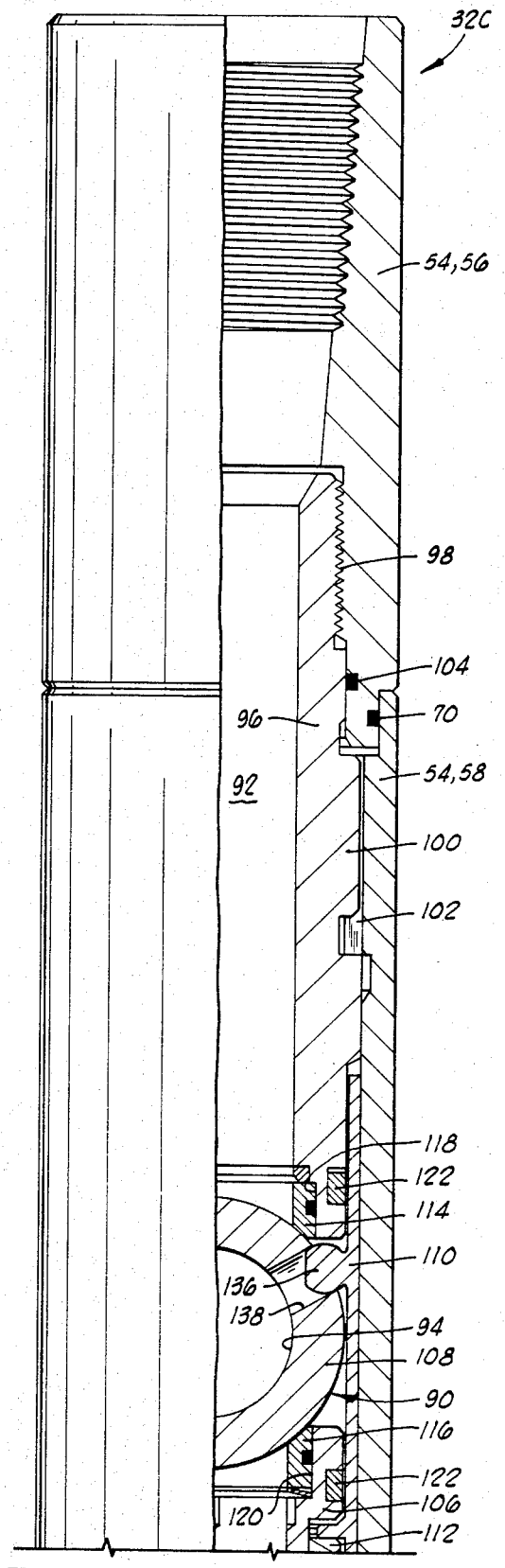
FIGS. 5A–5G comprise an elevation half-section view of a third embodiment of the present invention.
Figure 5B:
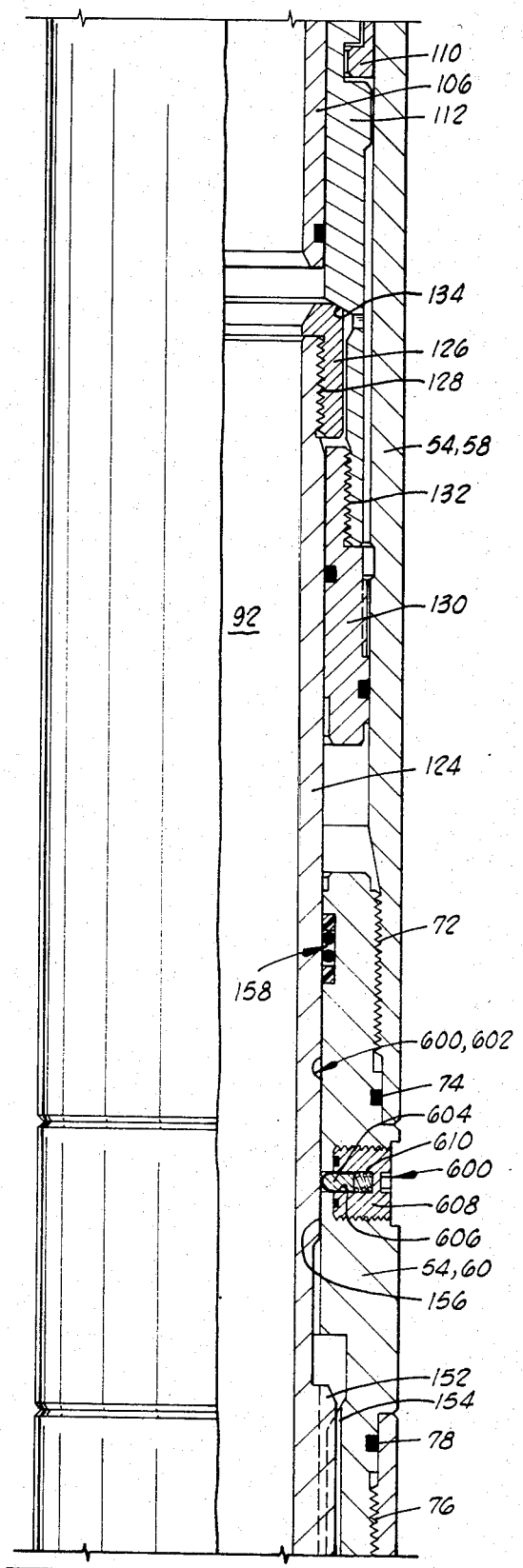

The one modification which has been made in this portion of the tester valve 32C, as compared to the tester valve 32A, is that a releasable holding means 600, shown in FIG. 5B, has been added.

Figure 5C:
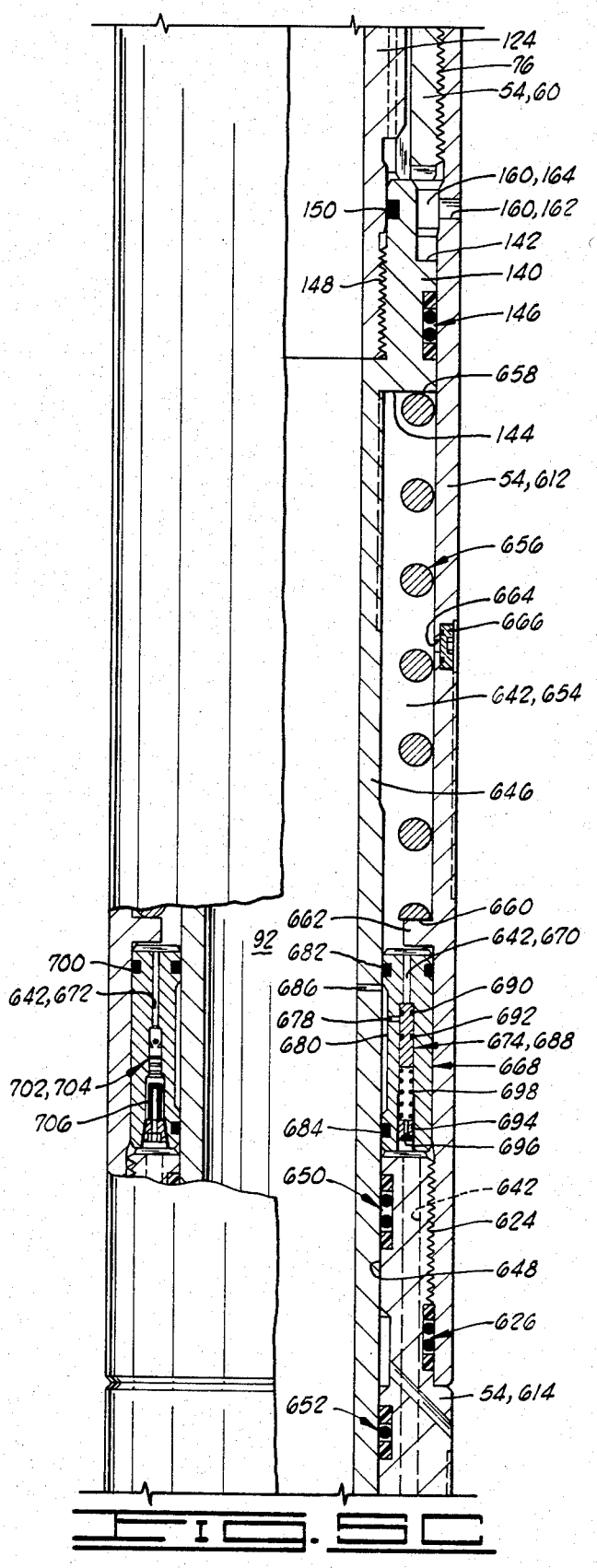

The releasable holding means 600 includes an indentation 602 disposed in the ball valve actuating mandrel 124. This ball valve actuating mandrel 124 is threadedly attached to the power piston 140 at threaded connection 148 as seen in FIG. 5C.

The releasable holding means 600 also includes a holding pin 604 which is radially slidably disposed in a radial bore 606 of the first middle adaptor section 60 of tool housing 54. The radial bore 606 is actually partially disposed in the first middle adaptor 60 and partially disposed in a threaded holding insert 608.

Releasable holding means 600 also includes a resilient pin biasing means 610, which is a coil compression spring 610, for biasing the holding pin 604 radially inward relative to the first middle adaptor 60 of tool housing 54.

The indentation 602 and holding pin 604 are so arranged and constructed that when the power piston 140 is moved downward to its second position, the indentation 602 is radially aligned with the holding pin 604 so that the holding pin 604 is moved into the indentation 602 by the pin biasing means 610 so that the power piston 140 is then releasably held in its second position.

Thus, the releasable holding means 600 may generally be described as a releasable holding means 600, operatively associated with the power piston 140, for releasably preventing the power piston 140 from returning to its first position.

As is further explained below, the releasable holding means 600 actually provides only a portion of the force necessary to hold the power piston 140 in its second position. The remainder of the necessary force is provided by a downward pressure differential maintained across power piston 140.

The tool housing 54 of tester valve 32C includes the upper adaptor 56, the valve housing section 58, the first middle adaptor 60, a power housing section 612, a second middle adaptor 614, an intermediate housing section 616, a third middle adaptor 618, a retarding shoe housing section 620, and a lower adaptor 622.

Power housing section 612 has its upper end threadedly connected to first middle adaptor 60 at threaded connection 76 with a seal provided therebetween by O-ring 78.

Second middle adaptor 614 has its upper end threadedly connected to power housing section 612 at threaded connection 624 with a seal provided therebetween by double O-ring sealing means 626.

Second middle adaptor 614 has its lower end threadedly connected to intermediate housing section 616 at threaded connection 628 with a seal provided therebetween by double O-ring sealing means 630.

Intermediate housing section 616 has its lower end threadedly connected to third middle adaptor 618 at threaded connection 632 with a seal being provided therebetween by O-ring 634.

Third middle adaptor 618 has its lower end threadedly connected to retarding shoe housing section 620 at threaded connection 636 with a seal being provided therebetween by O-ring 638.

Retarding shoe housing section 620 has its lower end threadedly connected to lower adaptor 54 at threaded connection 640.

Returning now to FIG. 5C, the first pressure conducting passage means 160 of tester valve 32C is substantially identical to the first pressure conducting passage means 160 of the tester valve 32A in that it includes the power port 162 and the annular cavity 164.

A second pressure conducting passage means 642 communicates the well annulus 42 with the second side 144 of power piston 140, and includes a balancing port 644 (see FIG. 5G) and a plurality of passages and cavities further described below.

Extending downward from power piston 140 is a guide mandrel means 646 which has its lower end portion closely and slidably received within an upper counterbore 648 of second middle adaptor 614. A sliding seal is provided therebetween by first and second seal means 650 and 652.

An annular cavity 654 is defined between guide mandrel means 646 and power housing section 612, and forms a part of the second pressure conducting passage means 642.

Disposed in an upper portion of annular cavity 654 is a resilient biasing means 656, which is a coil compression spring 656, operatively associated with the power piston 140 for biasing the power piston 140 toward its first position. The coil spring 656 has its upper end 658 engaging the second side 144 of power piston 140 and has its lower end 660 engaging a radially inward extending annular ledge 662 of power housing section 612.

As is further explained below, coil spring 656 is strong enough to overcome the holding force of releasable holding means 600, alone.

A filler port 664 is disposed through power housing section 612 and is closed by a threaded seal plug 666. The filler port 664 is utilized when filling the annular cavity 654 with oil.

Disposed in a lower portion of annular cavity 654 is an annular relief cartridge 668.

Relief cartridge 668 has first and second cartridge passages 670 and 672 disposed therethrough, which cartridge passages comprise a portion of second pressure conducting passage means 642.

A pressure relief means 674 is disposed in the first cartridge passage 670 for relieving from a first portion of the second pressure conducting passage means 642 a volume of fluid sufficient to permit the power piston 140 to travel to its second position. This first portion of the second pressure conducting passage means 642 is defined as the portion of the second pressure conducting passage means 642 between the second side 144 of power piston 140 and an annular sliding shoe-type retarding means 676 which is further described below.

The pressure relief means 674 is similar in its operation to the pressure relief means illustrated in FIG. 2D for tester valve 32A, but there are some differences in the construction thereof. Pressure relief means 674 is disposed in the pressure relief cartridge 668, which in the context of the present discussion may be referred to as a relief housing 668. A relief port 678 is disposed through the relief housing 668 and communicates with a longitudinal groove 680 disposed in the inner cylindrical surface of relief housing 668 between upper and lower internal seals 682 and 684.

Longitudinal groove 680 communicates with a dump passage 686 disposed through the guide mandrel means 646. The dump passage 686 communicates with the dump zone 92 which is also the central bore of the tester valve 32C.

A pressure relief piston means 688 is slidably disposed in the first cartridge passage 670 of relief housing 668 and is movable between a first position illustrated in FIG. 5C wherein the relief port 678 is closed, and a second downwardly displaced position wherein the relief port 678 is open.

Upper and lower O-ring seals 690 and 692 seal between the pressure relief piston means 688 and the cartridge passage 670.

A lower insert 694 is threadedly received in first cartridge passage 670 and has a longitudinal bore 696 therethrough.

A resilient relief piston biasing means 698, which is a coil compression spring 698, has its upper end engaging the lower end of pressure relief piston means 688 and has its lower end engaging the threaded insert 694. The compression load on the biasing means 698 may be adjusted by varying the threaded engagement of the insert 694 with the pressure relief cartridge 668.

An external seal 700 is provided between pressure relief cartridge 668 and an inner cylindrical surface of power housing section 612.

Illustrated on the left-hand side of FIG. 5C, is a run-in balance means 702 for allowing well annulus pressure to sufficiently balance across power piston 140 as the tester valve 32C is run into a well so that a pressure differential from the first side 142 to the second side 144 of power piston 140 is never sufficient to overcome the resilient biasing means 656 and prematurely move the power piston 140 to its second position as the tester valve 32C is being run into a well.

This run-in balance means 702 includes a second cartridge passage 672 which may also be referred to as a bypass portion 672 of the second pressure conducting passage means 642.

Run-in balance means 702 also includes a one-way check valve 704 disposed in the bypass portion or second cartridge passageway 672 for allowing fluid flow and thus pressure transmission in a first upward direction from the well annulus through the bypass portion 672 of the second pressure conducting passage means 642 to the second side 144 of power piston 140, and for preventing fluid flow in a reverse downward direction opposite said first direction.

Also illustrated in FIG. 5C is a filter 706 located below the check valve 704 for preventing contaminated materials from interferring with the operation of the check valve 704.

Figure 5D:
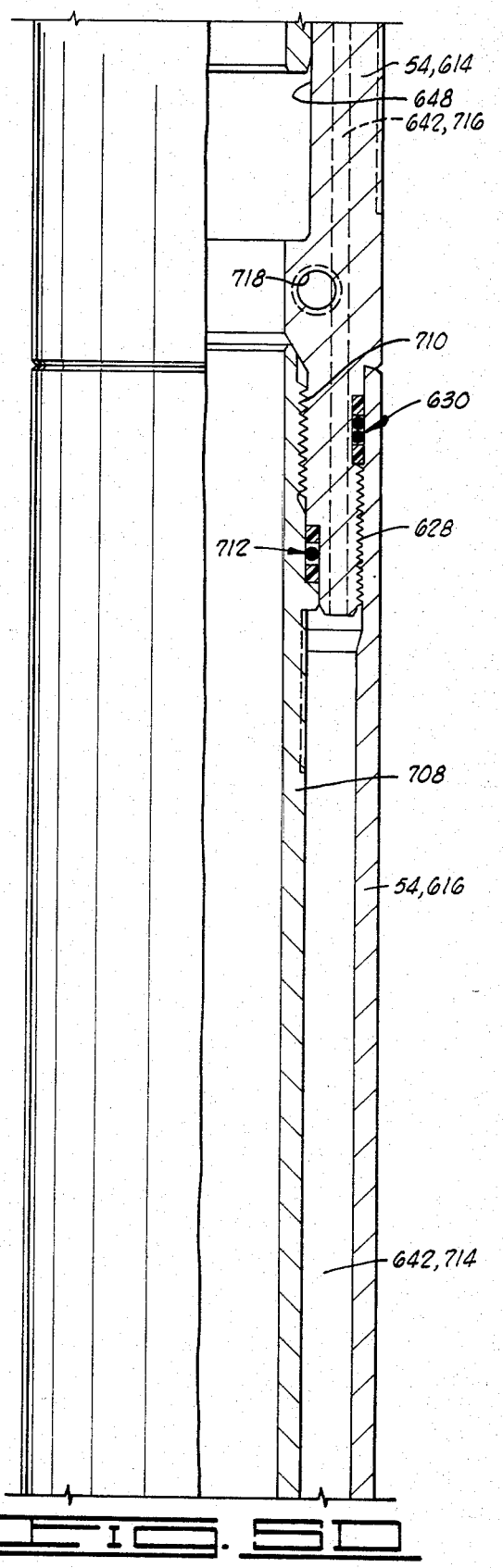

Referring now to FIG. 5D, an intermediate inner mandrel 708 has its upper end threadedly connected to an internal threaded portion of second middle adaptor 614 at threaded connection 710 with a seal being provided therebetween by O-ring seal means 712.

An annular cavity 714 is defined between intermediate inner mandrel 708 and intermediate housing section 616 and forms a part of the second pressure conducting passage means 642.

Second middle adaptor 614 has one or more longitudinal bores or passages 716 disposed through the length thereof communicating annular cavity 714 with annular cavity 654. The longitudinal passages 716 also comprise a part of the second pressure conducting passage means 642.

A transverse bore 718 is disposed through the body of second middle adaptor 614 and intersects the longitudinal bore 716. A filler valve (not shown) is disposed in transverse bore 718 for aid in filling the second pressure conducting passage means 642 with oil.

Figure 5E:
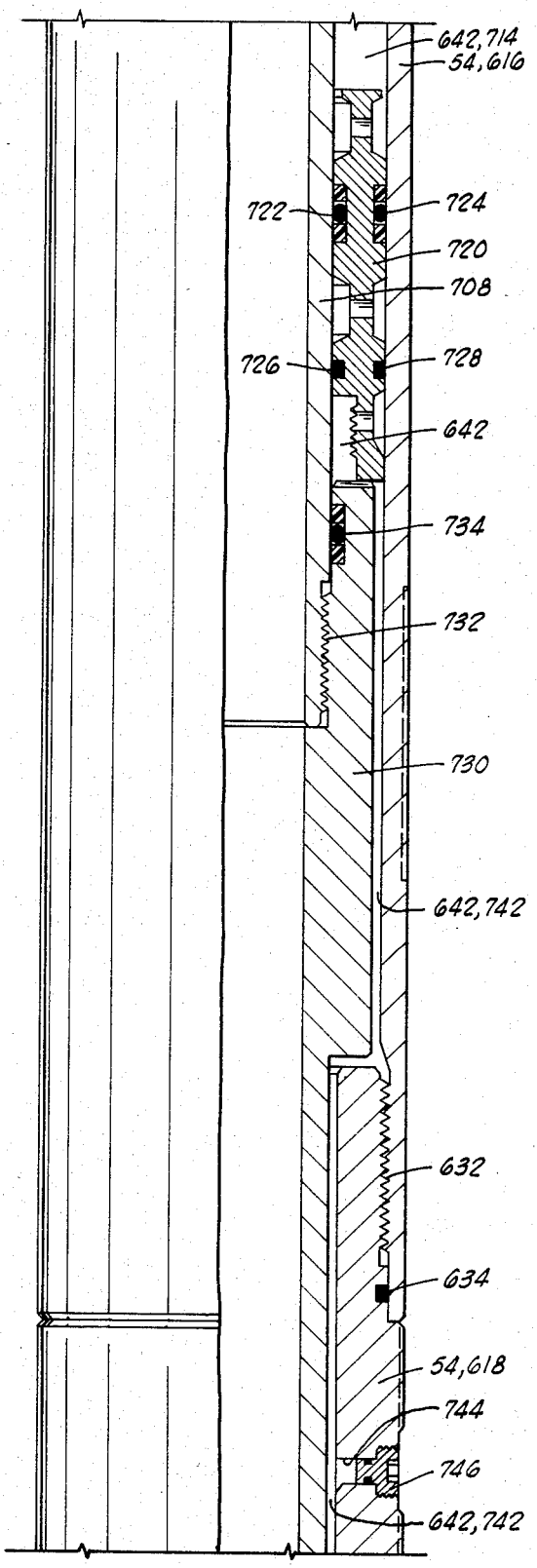
Figure 5F:
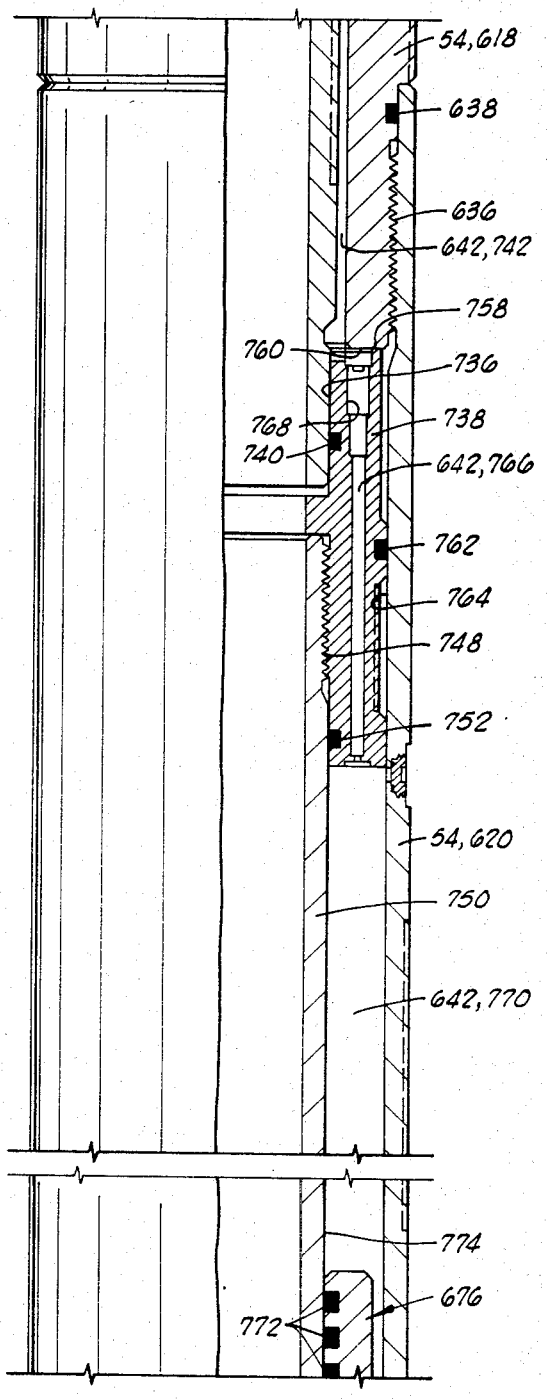
Figure 5G:
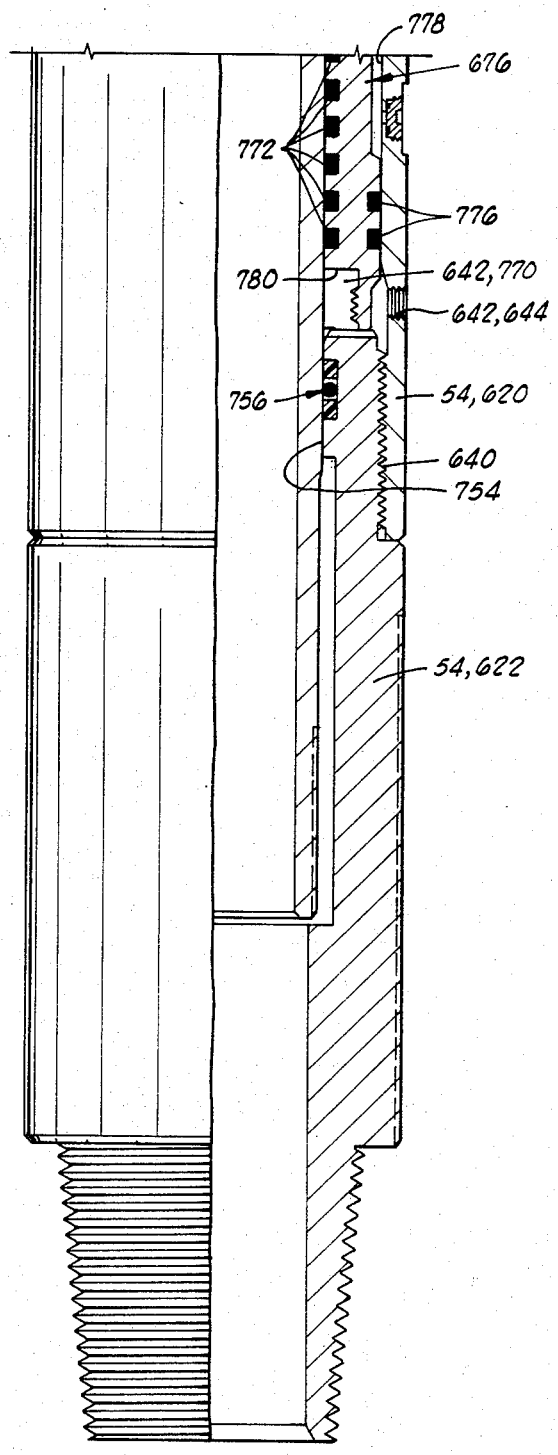

Referring now to FIG. 5E, an intermediate floating shoe 720 is disposed in an annular cavity 714. It includes inner and outer upper seals 722 and 724 sealing against intermediate inner mandrel 708 and intermediate housing section 616, respectively. It also includes inner and outer lower seals 726 and 728 sealing against intermediate inner mandrel 708 and intermediate housing section 616, respectively.

A mandrel extension 730 has its upper end threadedly connected to intermediate inner mandrel 708 at threaded connection 732 with a seal being provided therebetween by O-ring seal means 734.

Mandrel extension 730 has its lower end closely received within an upper counterbore 736 of a blank cartridge 738 which is located within the retarding shoe housing section 620. An annular seal is provided therebetween by O-ring seal 740.

An irregular annular cavity 742 is defined between mandrel extension 730 and both the lower portion of intermediate housing section 616 and an inner surface of third middle adaptor 618. The irregular annular cavity 742 has its upper end communicated with the annular cavity 714 and forms a portion of the second pressure conducting passage means 642.

A filler port 744 is disposed through third middle adaptor 618 and communicated with annular cavity 742. Filler port 744 is closed by a sealed threaded plug 746.

The blank adaptor 738 is threadedly connected at threaded connection 748 to the upper end of a lower mandrel 750 with a seal being provided therebetween by O-ring seal 752.

The lower inner mandrel 750 has a lower portion thereof closely received within an upper bore 754 of lower adaptor 622 with a seal being provided therebetween by O-ring seal means 756.

An upper end 758 of blank cartridge 738 abuts a lower end 760 of third middle adaptor 618. An annular O-ring seal 762 seals between the outer surface of blank adaptor 738 and an inner cylindrical surface 764 of retarding shoe housing section 620.

Blank cartridge 738 has a blank cartridge passageway 766 disposed therethrough. The passageway 766 is constructed so that it has an enlarged counterbore 768 at its upper end which is constructed so that it could receive a fluid restrictor similar to the fluid restrictor 262 shown in FIG. 2E. Nevertheless, in the preferred arrangement of the present embodiment, there is no fluid restrictor in the blank cartridge 738 and its cartridge passageway 766 merely serves as an unrestricted flow passage of the second pressure conducting passage means 642, and is communicated at its upper end with the irregular annular cavity 742. The blank cartridge 738, however, does provide the option of adding a fluid restrictor to the tester valve 32C to supplement the action of the annular sliding shoe retarding means 676 which is further discussed below.

An annular cavity 770 is defined between the lower inner mandrel 750 and retarding shoe housing section 620 and forms a part of the second pressure conducting passage means 642.

The annular sliding shoe retarding means 676 is received within the annular cavity 770. Annular sliding shoe retarding means 676 provides a means for delaying communication of a sufficient portion of an increase in well annulus pressure to the second side 144 of power piston 140 for a sufficient time to allow a pressure differential from the first side 142 to the second side 144 of power piston 140 to move power piston 140 from a first position to a second position relative to the tool housing 54.

The annular sliding shoe retarding means 676 is an annular floating shoe which is received within the annular cavity 770. It includes an inner resilient friction means 772 comprised of eight O-rings 772 which snugly and slidingly engage an outer cylindrical surface 774 of lower inner mandrel 750.

The annular sliding shoe retarding means 676 also includes outer resilient friction means 776 comprised of two O-rings snugly and slidingly engaging an inner cylindrical surface 778 of retarding shoe housing section 620.

The annular sliding shoe retarding means 676 serves the same function as the metering cartridge type of retarding means 244 previously described with regard to the tester valve 32A of FIGS. 2A–2E. The annular sliding shoe retarding means 676 provides a time delay in the communication of an increase or decrease in well annulus pressure to the second side 144 of power piston 140. This is accomplished in the following manner.

Although floating shoes are used in a large number of devices, those floating shoes are generally used for the purpose of dividing two fluids in a fluid passageway. Examples of such typical sliding shoes would be the floating shoe 238 shown in FIG. 2E which has only a single resilient seal on its inside and outside, and also the intermediate sliding shoe 720 illustrated in FIG. 5E which has two inner O-ring seals and two outer O-ring seals. In these typical types of annular floating shoes which are found throughout the prior art, the seals on the inner and outer surfaces of the annular shoe are merely for the purpose of providing a sliding seal between the annular shoe and the two cylindrical surfaces defining the annular cavity in which it slides. Although there is of course some friction between such an annular shoe and the cylindrical walls defining the annular cavity in which it fits, that friction is minimal and there is no significant time delay in the transmission of fluid pressure across the annular shoe.

The annular floating shoe retarding means 676 of the present invention, on the other hand, has a large number of O-ring seals 772 sealing with the lower inner mandrel 750, which number is greatly in excess of the number needed to provide a satisfactory seal with that lower inner mandrel 750.

Typically, no more than two O-rings such as the outer O-rings 776 are needed to provide a satisfactory seal between an annular floating shoe and a cylindrical member which it engages.

Thus, those O-rings 772 on the inside of annular floating shoe retarding means 676 in excess of two O-rings, are provided for the purpose of increasing the frictional resistance to movement of the annular floating shoe 676 relative to the lower inner mandrel 750.

By varying the number and the tightness of the inner O-rings 772, the amount of time delay provided by the annular floating shoe retarding means 676 can be varied.

With regard to transmission of increases in annulus fluid pressure, the annular floating shoe retarding means 676 functions very much like the metering cartridge 244 previously described with regard to the embodiments of FIGS. 2A–2E. Also, as is further explained below, the annular floating shoe retarding means 676 additionally functions in much the same manner as the back pressure check valve means 516 of FIG. 4C, in that it prevents a certain portion of the increase or decrease in annulus fluid pressure from ever being communicated to the second side 144 of power piston 140.

When an increase in annulus fluid pressure is applied to the annulus fluid in the well annulus 42, that increase is communicated through balancing port 644 to a lower side 780 of annular floating shoe retarding means 676. Due, however, to the frictional engagement of the multitude of inner O-rings 772 with the lower inner mandrel 750, the annular floating shoe retarding means 676 does not immediately move upward so as to transmit that increase in fluid pressure to the fluid above it in annular cavity 770. Instead, that movement occurs slowly thus providing a time delay in the transmission of that increase in annulus fluid pressure to the second side 144 of power piston 140.

Also, just like the metering cartridge type of retarding means 244 of FIGS. 2A–2E, the annular floating shoe retarding means 676 allows an additional portion of the increase in well annulus pressure to be communicated to the second side 144 of power piston 140 after the power piston 140 moves to its second position. This occurs because the power piston 140 moves to its second position much quicker than the annular floating shoe retarding means 676 can move in response to the increase in well annulus pressure. Thus, after the power piston 140 moves to its second position, the annular floating piston retarding means 676 continues to move upward due to the upward pressure differential thereacross until that upward pressure differential becomes too small to overcome the frictional resistance of the inner O-rings 772.

Since the entire increase in well annulus pressure is never communicated to second side 144 of power piston 140, a downward pressure differential will be maintained across power piston 140 so long as the increase in well annulus pressure is maintained on the well annulus 42. This downward differential is equal to the differential required across annular floating shoe retarding means 676 to overcome the frictional resistance of the inner O-rings 772.

This downward pressure differential, plus the holding force of releasable holding means 600 are greater than the upward biasing force of coil spring 656 and thus will act together to hold power piston 140 in its second position.

OPERATION OF THE EMBODIMENT OF FIGS. 5A–5G

The manner of operation of the tester valve 32C of FIGS. 5A–5G is generally as follows.

The tester valve 32C is initially oriented as illustrated in FIGS. 5A–5G and is made up in the testing string 28 in the position designated by the numeral 32 in FIG. 1.

The tester valve 32C is run down into the well defined by well casing 16 with the ball valve means 90 in its closed position closing the flow passage 92 of the tester valve 32C, and with the power piston 140 in its first position illustrated in FIG. 5C.

The resilient biasing means 656 biases the power piston 140 towards its first position.

As the tester valve 32C is run into the well, the increase in hydrostatic pressure in the well annulus fluid with increasing depth is sufficiently balanced across the power piston 140 so that a pressure differential from the first side 142 to the second side 144 of power piston 140 is never sufficient to overcome the resilient biasing means 656 and prematurely move the power piston 140 to its second position. This balancing is accomplished by means of the one-way check valve 704 which allows fluid flow and thus pressure transfer through the second pressure conducting passage means 642 from the balancing port 644 to the second side 144 of power piston 140.

When the tester valve 32C is located in the position designated by the numeral 32 in FIG. 1, the packer means 44 of the testing string is 28 is set against the well casing 16 to separate the well annulus 42 into an upper portion located above the packer means 44 and a lower portion 48 located below the packer means 44.

Both power port 162 and the balancing port 644, and the first and second pressure conducting passage means 160 and 642, are communicated with the upper portion of well annulus 42 above the packer means 44.

The central bore flow passage 92 of the tester valve 32C is communicated with the lower portion 48 of well annulus 42 below the packer means 44.

After the packer means 44 has been set, an increase in annulus fluid pressure is applied to the annulus fluid in the upper portion of well annulus 42 of packer means 44.

This increase in annulus fluid pressure is substantially immediately communicated to the first side 142 of power piston 140 through the first pressure conducting passage means 160.

The increase in annulus fluid pressure is not immediately communicated to the second side 144 of power piston 140, however, because of the time delay action provided by the annular floating shoe retarding means 676. The annular floating shoe retarding means 676 delays communication of a sufficient portion of the increase in annulus fluid pressure to the second side 144 of power piston 140 for a sufficient time to allow a pressure differential from the first side 142 to the second side 144 of power piston 140 to move the power piston 140 to its second position. This delaying is accomplished by means of the inner O-rings 772 of annular floating shoe retarding means 676 which frictionally retard movement of the annular floating shoe retarding means 676 due to their snug engagement with the outer cylindrical surface 774 of lower inner mandrel 750.

Thus a downward pressure differential is created across the power piston 140, and also across the pressure relief means 688.

This downward pressure differential across the pressure relief piston means 688 causes the pressure relief means 688 to move downward to an open position overcoming the biasing effect of spring 698. This downward movement is allowed due to the compressibility of the silicone oil in the second pressure conducting passage means 642 below the pressure relief piston means 688.

When the pressure relief piston means 688 moves downward it opens the pressure relief port 678.

This allows the power piston 140 to move downward from its first position to its second position relieving fluid from the second pressure conducting passage means 642 through the relief port 678, the longitudinal groove 680, and the dump passage 686 into the dump zone 92. The volume of fluid relieved is sufficient to permit the power piston 140 to travel to its second position and is equal to the displacement of the power piston in moving from its first to its second position.

When the power piston 140 moves from its first position to its second position its moves the ball valve means 90 from the closed position illustrated in FIG. 5A to an open position wherein the bore 94 of ball 108 is in alignment with the flow passage central bore 92 of the tester valve 32C.

When the power piston 140 reaches its second position, the holding pin is biased by pin biasing means 610 into engagement with the identation 602 of the operating mandrel 124 thereby releasably holding the power piston 140 in its second position.

With the embodiment of FIGS. 5A–5G, however, it is necessary that the increase in annulus fluid pressure applied to the well annulus 42 be maintained in order to hold the power piston 140 in its second position and hold the ball valve means 190 in its open position.

These are two forces which act together to hold the power piston 140 in this second position. The first is the engagement of the holding pin 604 with the indentation 602. The second is a continuing downward pressure differential across power piston 140 which occurs because of the fact that the annular floating shoe retarding means 676 never completely communicates all of the increase in annulus pressure to the second side 144 of power piston 140.

Due to the frictional engagement of annular floating shoe retarding means 676 with the lower inner mandrel 750, the annular floating shoe retarding means 678 functions much like the back pressure check valve means 516 of FIG. 4C in that it permanently prevents a portion of the increase in annulus fluid pressure from reaching the second side 144 of power piston 140. The amount of pressure which cannot be communicated across annular floating piston retarding means 676, causes a pressure differential of that same amount downward across power piston 140. This downward pressure differential, plus the force required to disengage the holding pin 604 is sufficient to prevent the resilient biasing means 656 from overcoming the force of the holding pin 604 engaging identation 602 to move the power piston 140 back to its first position.

In order to move the power piston 140 back to its first position, the increase in annulus pressure must be decreased so as to eliminate the downward pressure differential across power piston 140, then the resilient biasing means 656 overcomes the releasable holding force of the holding pin 604 engaging identation 602, thus disengaging holding pin 604 from identation 602 and moving power piston 140 back to its upper first position and moving ball valve means 90 to its closed position.

When the power piston 140 moves back upward to its first position, fluid flows through check valve means 704 into the annular cavity 654 to replace the fluid which was lost on the downward stroke of the power piston 140.

If the intermediate floating shoe 720 is not used, the number of times which the tester valve 32C can be cycled between the open and closed positions of the ball valve means 90 is dependent upon the volume of fluid within annular cavity 770 which can be displaced as the annular floating shoe retarding means 676 moves upward in the annular cavity 770. When the upper end of annular floating shoe retarding means 676 engages the lower end of blank cartridge 738, the tester valve 32C must be removed from the well and the annular cavity 770 refilled with fluid.

Sometimes it may be desired to utilize the intermediate floating shoe 720 and fill the second pressure conducting passage means 642 with silicone oil above intermediate floating shoe 720 and a non-compressible oil between intermediate floating shoe 720 and annular floating shoe retarding means 676. Such a situation might arise if a fluid restrictor were used in blank cartridge 738 and there was a problem of foaming of the silicone oil.

If intermediate floating shoe 720 is utilized, then the number of times which the tester valve 32 can be cycled between the open and closed positions of the ball valve means 90 is dependent upon the volume of fluid either in annular cavity 714 above intermediate floating shoe 720 or in annular cavity 770 above annular floating shoe retarding means 676, whichever is lesser.

As previously mentioned with regard to the other embodiments, the fluid in the second pressure conducting passage means above the annular floating shoe retarding means 676 is preferably silicone oil. The slight compressibility of the silicone oil allows the pressure relief piston means 688 to move downward to its open position. The silicone oil is not compressible enough, however, to allow the power piston 140 to move downward, without having the oil relieved to the dump zone 92.

THE EMBODIMENT OF FIGS. 6A–6E, 7 and 8

Referring now to FIGS. 6A–6E, a fourth embodiment of the tester valve of the present invention is shown and generally designated by the numeral 32D. Those portions of the tester valve 32D from the upper adaptor 56 down to the about the level of the power piston 140 are identical or substantially similar to the analogous components of the tester valve 32A shown in FIGS. 2A–2C, and those identical or substantially similar components are designated by the same numerals as used in FIGS. 2A–2C. The detailed description of those identical or substantially similar components will not be repeated.

The tool housing 54 of tester valve 32D includes the upper adaptor 56, the valve housing section 58, the first middle adaptor 60, a power and relief housing section 800, a second middle adaptor 802, a cartridge housing section 804 and a lower adaptor 806.

The power and relief housing section 800 is threadedly connected to first middle adaptor 60 at threaded connection 76 and a seal is provided therebetween by O-ring 78.

The second middle adaptor 802 is threadedly connected to power and relief section 800 at threaded connection 808 and a seal is provided therebetween by double O-ring seal means 810.

The cartridge housing section 804 is threadedly connected to the lower end of second middle adaptor 802 at threaded connection 812 and a seal is provided therebetween by double O-ring seal means 814.

The lower adaptor 806 is threadedly connected to cartridge housing section 804 at threaded connection 816.

The first pressure conducting passage means 160 including the power port 162 and the annular cavity 164 is substantially identical to the first pressure conducting passage means 160 previously described with regard to the embodiment of FIGS. 2A–2D.

A second pressure conducting passage means 818 includes a balancing port 820 and a number of other passageways communicating the well annulus 42 with the second side 144 of power piston 140. Those other passageways are described in more detail below.

The second middle adaptor 802 has an upper end of a lower inner mandrel 822 threadedly attached thereto at 824 with a seal means being provided therebetween by O-ring sealing means 826.

Lower inner mandrel 822 has a lower end portion closely and sealingly received within an upper bore 823 of lower adaptor 806 with a seal being provided therebetween by O-ring seal means 825.

The lower inner mandrel 822 has an enlarged diameter outer cylindrical surface 828 at an intermediate portion thereof. A metering cartridge 830 is closely received about surface 828 and held in place relative to the lower inner mandrel 822 by a threaded collar 832 connected at threaded connection 834 to lower inner mandrel 822. The threaded collar 832 holds the metering cartridge in place against a radially outwardly ledge 836 at the upper end of enlarged diameter surface 828.

Inner and outer O-ring seals 831 and 833 seal between metering cartridge 830 and lower inner mandrel 822 and cartridge housing section 804, respectively.

The metering cartridge 830 has a cartridge passageway 838 disclosed therethrough which forms a portion of the second pressure conducting passage means 818.

A fluid restrictor 840, having a reduced diameter fluid orifice (not shown) located therein is disposed in cartridge passageway 838.

The metering cartridge 830 may be described as a retarding means 830 disposed in the second pressure conducting passage means 818 for delaying communication of a sufficient portion of an increase in well annulus pressure to the second side 144 of power piston 140 for a sufficient time to allow a pressure differential from the first side 142 to the second side 144 of power piston 140 to move said power piston 140 from a first position to a second position relative to the housing 54.

An annular cavity 840 is defined between the lower inner mandrel 822 and the cartridge housing section 804 below the metering cartridge 830. Annular cavity 840 is communicated with balancing port 820.

An annular cavity 842 is defined between lower inner mandrel 822 and cartridge housing section 804 above the metering cartridge 830.

The cartridge passageway 838 disposed through metering cartridge 830 communicates the annular cavities 840 and 842, all of which form a portion of the second pressure conducting passage means 818.

An annular floating shoe 844 is disposed in annular cavity 840 and it has inner and outer seals 846 and 848, respectively, slidingly sealingly engaging lower inner mandrel 822 and cartridge housing section 804, respectively. The annular floating shoe 844 merely serves to separate the fluid from well annulus 42 which enters balancing port 820 from the silicone oil or other working fluid contained in the annular cavity 840.

The primary difference between the tester valve 32D of FIGS. 6A–6E, and the other embodiments previously discussed, is in the construction of the pressure relief means and the run-in balance means. The three embodiments previously discussed all included a pressure relief means including a spring biased pressure relief piston which moved between closed and open positions to close and open a relief port directed to a dump zone. Thus those pressure relief means where hydraulically actuated by a pressure differential across the pressure relief piston.

The embodiment of FIGS. 6A–6E, on the other hand, includes a positively mechanically actuated pressure relief means, which is further described below.

An operating mandrel 850 extends downward from power piston 140 and has its lower end closely and slidably received in an upper counter bore 852 of second middle adaptor 802. A sliding seal means is provided therebetween by O-ring 854.

Operating mandrel 850 has a reduced diameter outer cylindrical surface 856 defined on a lower portion thereof.

A ratchet mandrel 858 is closely and rotatably received about outer surface 856. Ratchet mandrel 858 is held in place relative to operating mandrel 850 by a locking ring 859 which fits in an annular groove 861 disposed in the outer surface of operating mandrel 850 immediately below the lower end 863 of ratchet mandrel 858.

A dump mandrel 860 is concentrically disposed between ratchet mandrel 858 and power and relief housing section 800. The lower end 862 of dump mandrel 860 abuts an upper end 864 of second middle adaptor 802.

A resilient biasing means 866, which is a coil compression spring 866, is operatively associated with power piston 140 for biasing the power piston 140 toward its first position. Coil compression spring 866 has an upper end 868 which engages second side 144 of power piston 140, and has a lower end 870 which engages an upper end 872 of dump mandrel 860.

An annular cavity 874 is defined between dump mandrel 860 and power and relief housing section 800, and forms a part of second pressure conducting passage means 818.

A longitudinal bore 876 disposed through the length of second middle adaptor 802 communicates annular cavity 874 with annular cavity 842.

An annular cavity 878 is defined between operating mandrel 850 and pressure and relief housing section 800 above the dump mandrel 860. Annular cavity 878 forms a part of second pressure conducting passage means 818 and is communicated with annular cavity 874 and with the second side 144 of power piston 140.

The operating mandrel 850, ratchet mandrel 858, and dump mandrel 860 are constructed to provide a pressure relief means 880. The pressure relief means 880 is communicated with the first portion of second pressure conducting passage means 818. The first portion of second pressure conducting means 818 is defined as the portion between the second side 144 of power piston 140 and the retarding means 830. Pressure relief means 880 is a means for relieving from said first portion of second pressure conducting passage means 818 a volume of fluid sufficient to permit power piston 140 to travel to its second position.

As with the other embodiments previously discussed, a central bore 92 of the tester valve 32D also functions as a fluid dump zone 92.

A fluid dump passage means 882 communicates the annular cavity 874 of second pressure conducting passage means 818 with the fluid dump zone 92 in following manner.

The fluid dump passage means 882 includes a first radial port 884 disposed through dump mandrel 860.

Fluid dump passage means 882 also includes a first flow space 886 defined between dump mandrel 860 and ratchet mandrel 858 and communicated with first port 884.

Fluid dump passage means 882 further includes a second port 888 disposed through ratchet mandrel 858 and communicated with first flow space 886.

Also included in fluid dump passage means 882 is a second flow space 890 defined between ratchet mandrel 858 and operating mandrel 850, said second flow space 890 being communicated with said second port 888.

Finally, fluid dump passage means 882 includes a third port 892 disposed through operating mandrel 850 and communicating said second flow space 890 with the central bore dump zone 92 of operating mandrel 850.

First and second annular seal means 894 and 896 are disposed between dump mandrel 860 and ratchet mandrel on opposite sides of both said first and second ports 884 and 888.

Third and fourth annular seal means 898 and 900 are disposed between ratchet mandrel 858 and operating mandrel 850 on opposite sides of third port 892.

The first flow space 886 is divided into first and second parts 902 and 904 by an annular divider seal means 906 disposed between dump mandrel 860 and ratchet mandrel 858. Said first and second parts 902 and 904 of first flow space 886 are communicated with first port 884 and second port 888, respectively.

Ratchet mandrel 858 has an intermediate flow passage 908 disposed therein communicating the first and second parts 902 and 904 of the first flow space 886.

A flapper-type check valve means 909 is connected to the ratchet mandrel 858 covering an upper end of intermediate flow passage 908 and is thus disposed between the second part 904 of first flow space 886 and the intermediate flow passage 908, for preventing fluid flow from the second part 904 of first flow space 886 backward into the intermediate flow passage 908. Flapper check valve means 909 permits flow from intermediate flow passage 908 into the second part 904 of first flow space 886.

The check valve 909 is necessary to prevent flow of fluid from the central bore 92 of tester valve 32D into the intermediate passage 908 of dump passage means 882 when pressure in the central bore 92 of the tester valve 32D is greater than the annulus pressure, such as for example is the case during an acidizing or fracturing job when the testing string 28 is actually being used to pump liquids down into a well to treat the well.

Pressure relief means 880 includes a fluid dump valve 910 which is disposed between the annular cavity 874 of second pressure conducting passage means 818 and the fluid dump passage means 882.

Fluid dump valve 910 is a flapper-type valve which has a flapper portion 914 movable between a closed position as illustrated isolating annular cavity 874 of second pressure conducting passage means 818 from the fluid dump passage means 882, and an open position wherein flapper portion 914 is moved radially outward to allow fluid flow from annular cavity 874 of second pressure conducting passage means 818 into and through the fluid dump passage means 882.

An operating means 916, operatively associated with power piston 140 and fluid dump valve 910, moves the fluid dump valve 910 to its open position as the power piston 140 starts to move from its said first position downward toward its second position. Operating means 916 also is a means for holding the fluid dump valve 910 in its said open position until the power piston 140 reaches it said second position, and then operating means 916 returns the fluid dump valve 910 to its said closed position after power piston 140 reaches its said second position.

The operating means 916 includes a spherical operating ball 918 which is closely and slidably received in the first port 884 and which engages a radially inner surface 920 of flapper-type fluid dump valve 910.

Operating means 916 further includes a cam means 922, operatively associated with the power piston 140 for movement therewith, for camming the operating ball 918 radially outward toward the flapper-type fluid dump valve 910 and thereby opening the flapper-type fluid dump valve 910 as the power piston 140 starts to move from its said first position toward its said second position.

Figure 8:
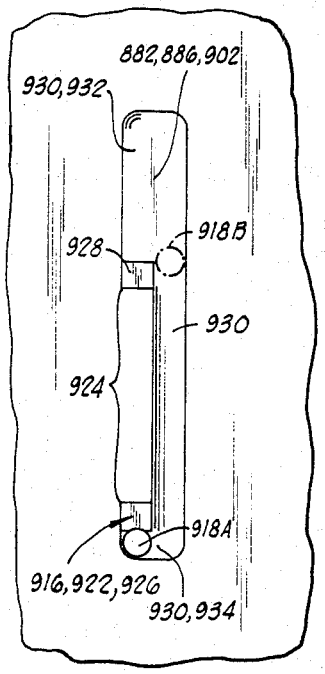
FIG. 8 is a layed out view of a cam surface and accompanying ball receiving groove disposed in the lower portion of ratchet mandrel 858 of the embodiment of FIGS. 6A–6E.

The cam means 922 of operating means 916 is best illustrated in FIG. 8 which is a layed out view thereof taken from the viewpoint of a viewer looking radially inward toward the radially outer surface of ratchet mandrel 858.

The cam means 922 includes a longitudinally oriented cam surface 924 having ramp portions 926 and 928 at the lower and upper ends thereof, respectively.

Cam means 916 further includes a return groove 930 oriented parallel to longitudinally oriented cam surface 924, which return groove has upper and lower transverse portions 932 and 934, respectively, which communicate the return groove 930 with the ramp portions 928 and 926.

The operation of the cam means 922 and the return groove 930 in cooperation with the operating ball 918 is described below.

Before describing that operation of the cam means 922, however, it is helpful to describe a ratchet means 936 which is operatively associated with the power piston 140 and the cam means 922, for disengaging the cam means 922 from the operating ball 918 and thereby allowing the flapper valve 910 to close after the power piston 140 reaches its second position.

Ratchet means 936 includes a radially inward extending ball lug 938 which is held in placed in a radial bore 940 of dump mandrel 860 by a threaded retainer 942.

The ball lug 938 is received within a ratchet groove 944 of ratchet means 936. The ratchet groove 944 is disposed in the radially outer surface of ratchet mandrel 858, and is best seen in FIG. 7 which is a layed out view of ratchet groove 944 as viewed by a viewer looking radially inward toward the radially outer surface of ratchet mandrel 858.

Originally, the operating lug 918 is in a position as illustrated in solid lines in FIG. 8 as 918A wherein it is in engagement with and directly below the lower ramp 926 of the cam means 922.

Figure 7:
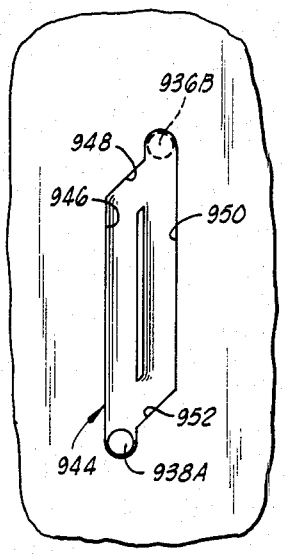
FIG. 7 is a layed out view of a ratchet groove disposed in ratchet mandrel 858 which comprises a portion of the ratchet means of the embodiment of FIGS. 6A–6E.

At that same time, the ball lug 938 of ratchet means 936 is in a position illustrated by the numeral 938A in FIG. 7 at the lower end of first longitudinal groove portion 946 of ratchet groove 944.

As the power piston 140 moves downward, the operating mandrel 850 and ratchet mandrel 858 move downward with the power piston 140.

As soon as this downward movement begins, the operating ball 918 rides up on the lower ramp 926 and onto the longitudinally oriented cam surface 924. Throughout that portion of the stroke of power piston 140 wherein the operating ball 918 is in engagement with the longitudinally oriented cam surface 924, the flapper dump valve 910 is held in an open position allowing fluid to be relieved from the annular cavity 874 of second pressure conducting passage means 818.

Throughout this downward movement of power piston 140, the ball lug 938 of ratchet means 936 travels upward through a first longitudinal groove portion 946 of ratchet groove 944 and then through an upper transverse groove portion 948 to a second upwardmost position relative to ratchet mandrel 858, which second position is designated in phantom lines by the numeral 936B.

Toward the end of the downward stroke of power piston 140, as the ball lug 938 of ratchet means 936 moves through the upper transverse groove portion 948 of ratchet groove 944, the ratchet mandrel 858 is rotated clockwise, as viewed from above, relative to power and relief housing section 800, thus rotating the longitudinally oriented cam surface 924 of cam means 922 out from under operating ball 918 allowing operating ball 918 to drop into an upwardmost position 918B, indicated in phantom lines, within the return groove 930 shown in FIG. 8.

Once the operating ball 918B drops into the return groove 930, the flapper dump valve 910 is allowed to return to a closed position.

When the power piston 140 is once again moved upward to its first position, the return groove 930 moves upward past the operating ball 918 while a corresponding second longitudinal groove portion 950 of ratchet groove means 944 moves upward past ball lug 938, and finally when ball lug 938 engages a lower transverse groove portion 952 of ratchet groove 944, the ratchet mandrel 858 is rotated counter-clockwise as viewed from above relative to power and relief housing section 800 thus returning the ball lug 938 to the position 938A illustrated in FIG. 7 and returning the operating ball 918 to the position 918A illustrated in FIG. 8.

Figure 6A:
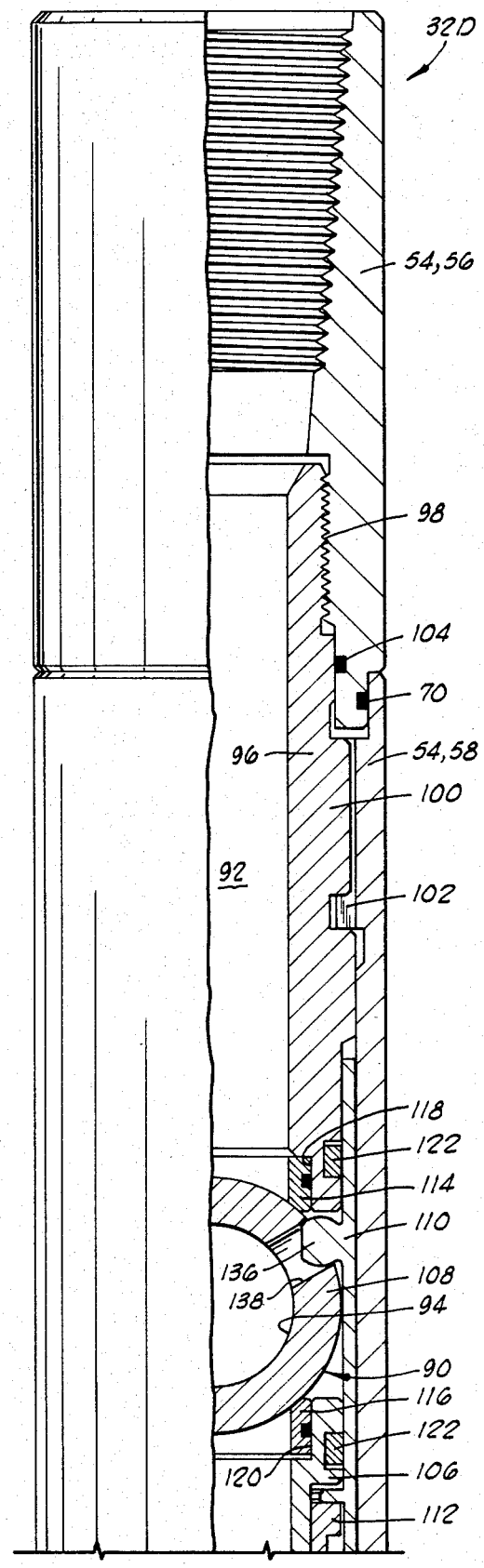
FIGS. 6A–6E comprise an elevation half-section view of a fourth embodiment of the present invention.
Figure 6B:
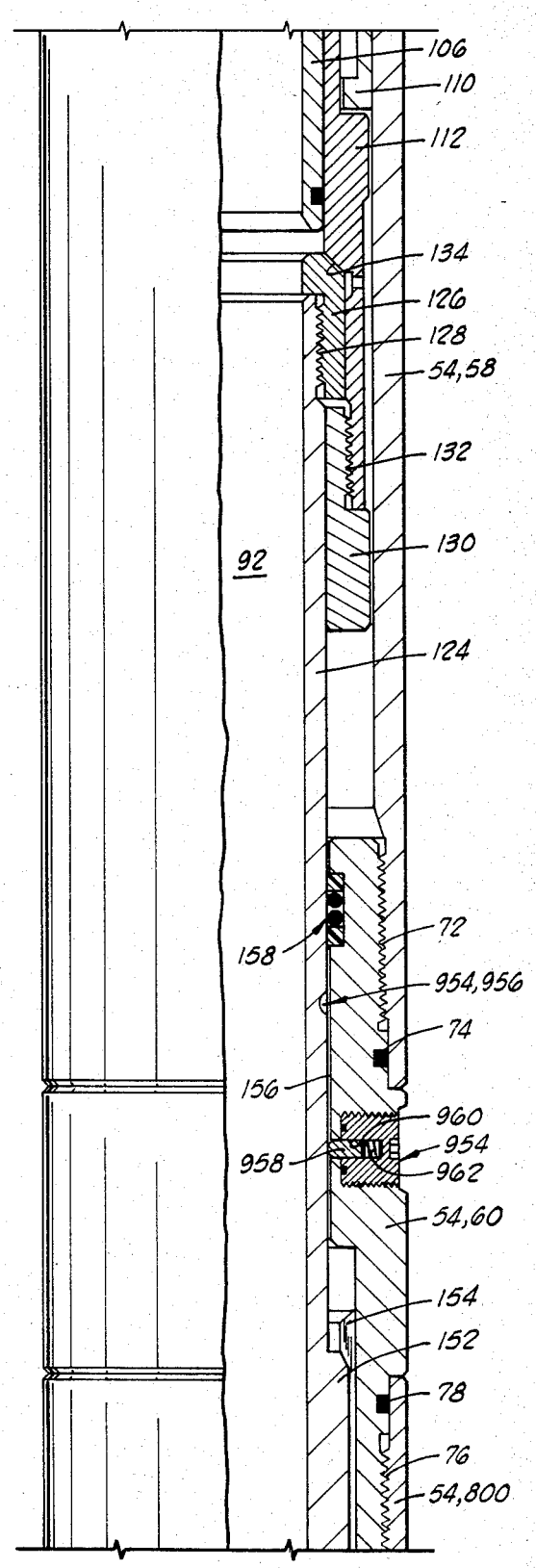
Figure 6C:
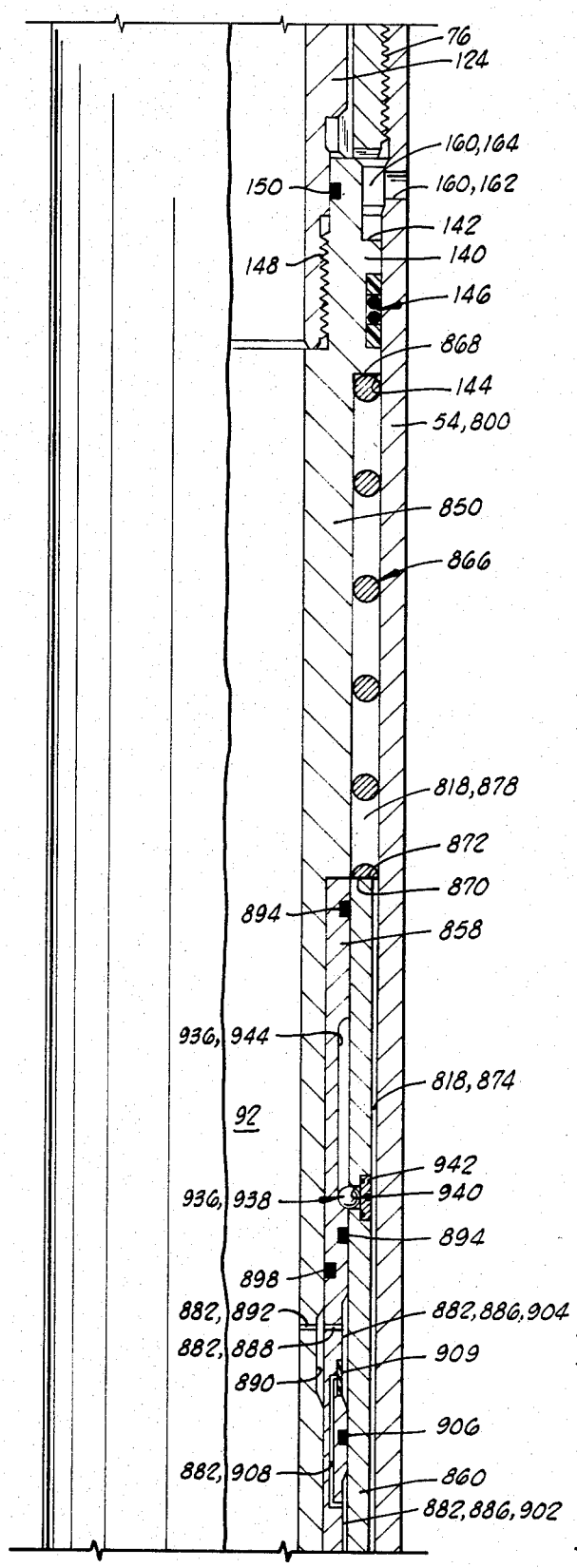
Figure 6D:
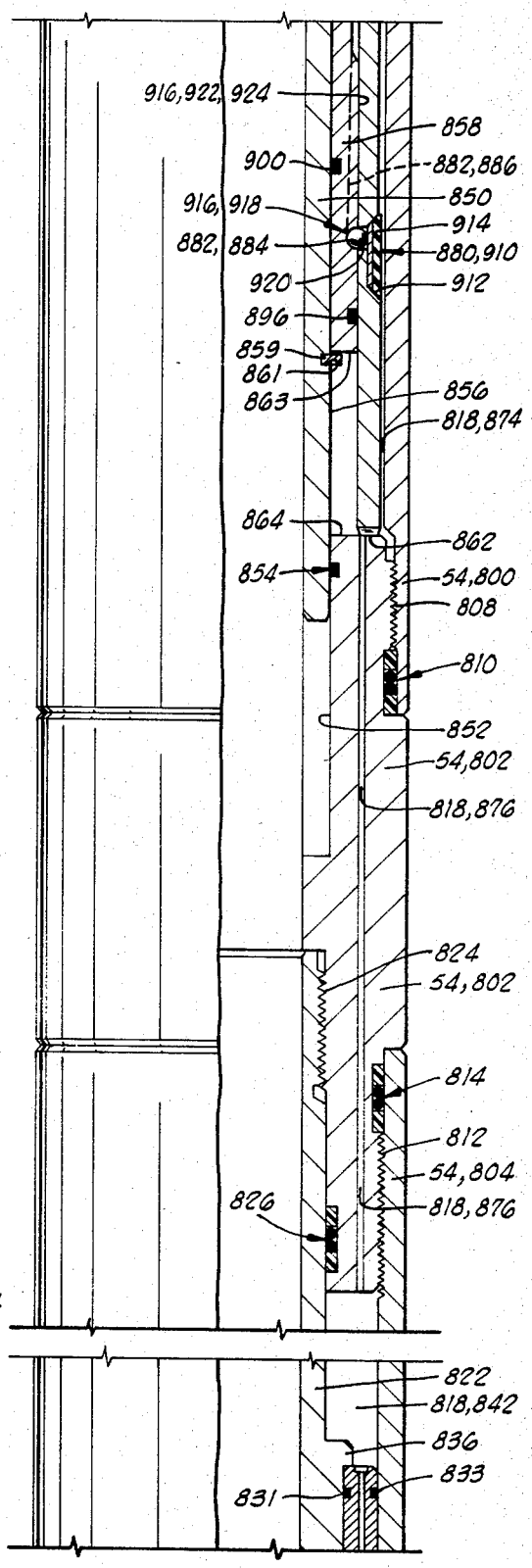

Referring now to FIG. 6B, a releasable holding means 954, is operatively associated with power piston 140, for releasably preventing the power piston 140 from returning to its first position.

The releasable holding means 954 includes an indentation 956 disposed in actuating mandrel 124, and a holding pin 958 slidably disposed in a radial bore 960 of first middle adaptor 60 of tool housing 54.

A resilient pin biasing means 962, which is a coil compression spring 962, biases the holding pin 958 radially inward.

The indentation 956 and holding pin 958 are so arranged and constructed that when the power piston 140 is in its said second position, the indentation 956 is aligned with holding pin 958 so that the holding pin 958 is moved into the indentation 956 by the pin biasing means 962 so that the power piston 140 is releasably held in its second position.

The coil spring 866 is not strong enough to overcome the holding force of releasable holding means 954. Coil spring 866 must be assisted by an upward pressure differential across power piston 140 to return power piston 140 to its first position.

In the tester valve 32D, the second pressure conducting passage means 818 is always in fluid communication throughout its length with balancing port 820. Thus, the second pressure conducting passage means 818 itself functions as a run-in balance means 818 for allowing well annulus pressure to sufficiently balance across power piston 140 as tester valve 32D is run into a well so that a pressure differential from first side 142 to second side 144 of power piston 140 is never sufficient to overcome biasing spring 866 and prematurely move power piston 140 to its second position as tester valve 32D is run into the well.

MANNER OF OPERATION OF THE EMBODIMENT OF FIGS. 6A–6E, 7 AND 8

The manner of operation of the tester valve 32D shown in FIGS. 6A–6E, 7 and 8 is generally as follows.

The tester valve 32D is first set up in the orientation illustrated in FIGS. 6A–6E and is made up in the testing string 28 in the position designated by the numeral 32 in FIG. 1. Then the testing string including the tester valve 32D is run into the well defined by well casing 16, with the ball valve means 90 in its closed position closing the central bore flow passage 92 of the tester valve 32D, and with the power piston 140 in its first position as illustrated.

The coil compression spring 866 resiliently biases the power piston 140 towards its first position.

As the tester valve 32D is run into the well, the increase in hydrostatic well annulus pressure, which occurs with increasing depth in the well, is sufficiently balanced across the power piston 140 so that a pressure differential from the first side 142 to the second side 144 of power piston 140 is never sufficient to overcome the resilient biasing means 866 and prematurely move the power piston 140 to its second position.

This balancing of the increase in hydrostatic well annulus pressure as the tester valve 32D is run into the well is accomplished by the fact that the second pressure conducting passage means 818 is always in fluid communication throughout its length with the balancing port 820.

Due to the fact that the tester valve 32D uses a positive mechanical means of opening the flapper dump valve 910, rather than a hydraulically actuated pressure relief means such as the first three embodiments have shown, there is nothing like the pressure balance valve of the other embodiments blocking communication of pressure through the second pressure conducting passage means.

After the tester valve 32D is lowered into place in the well to the position illustrated in FIG. 1, the packer means 44 is set in the well casing 16 to separate the well annulus 42 into an upper portion above the packer means 44 and a lower portion 48 below the packer means 44.

Both the power port 162 and the balancing port 820, and the first and second pressure conducting passage means 160 and 818, respectively, are communicated with the upper portion of the well annulus 42 above the packer means 44.

The central bore flow passage 92 of the tester valve 32D is communicated with the lower portion 48 of the well annulus 42 below the packer means 44.

After the packer means 44 has been set, an increase in annulus fluid pressure is applied to the annulus fluid in the upper portion of the well annulus 42 above the packer means 44.

This increase in annulus fluid pressure is substantially immediately communicated to the first side 142 of power piston 140 through the first pressure conducting passage means 160.

The metering cartridge retarding means 830 delays communication of a sufficient portion of this increase in annulus fluid pressure to the second side 144 of the power piston 140 for a sufficient time to allow a pressure differential from the first side 142 to the second side 144 of power piston 140 to move the power piston 140 to its open position.

As soon as the power piston 140 begins to move downward, the cam means 922 cams the operating ball 918 radially outward to open the flapper dump valve 910.

Then as the power piston 140 continues to move downward from its first position to its second position, fluid from the second pressure conducting passage means 818 is relieved through the dump valve 910 and through the dump passage 882 to the dump zone 92. The volume of fluid relieved is equal to the volume of fluid displaced by the power piston 140 as it moves from its first position to its second position.

As the power piston 140 reaches the bottom end of its downward stroke, the ratchet means 944 rotates the ratchet mandrel 858 causing the operating ball 918 to move transversely off of the longitudinally oriented cam surface 924 so that it drops into the return groove 930.

As the power piston 140 moves to its second position, the ball valve means 90 is rotated to its open position wherein the bore 94 of ball 108 is aligned with the central bore flow passage 92 of tester valve 32D.

The cartridge type retarding means 830 allows an additional portion of the increase in the well annulus pressure to be communicated to the second side 144 of the power piston 140 after the power piston 140 is moved to its second position, thus ultimately allowing the increase in well annulus pressure to substantially entirely balance across the power piston 140.

In the tester valve 32D, the coil spring biasing means 866 is so constructed that acting by itself it is not strong enough to overcome the holding force of the releasable holding means 954. This is necessary because, in the tester valve 32D, the increase in well annulus pressure will ultimately, after a few minutes, completely balance across the power piston 140 so that there is no downward pressure differential acting on the power piston 140.

To reclose the ball valve means 90 in the tester valve 32D, a decrease in annulus fluid pressure is rapidly applied to the well annulus 42, thus creating an upward pressure differential across the power piston 140 because of the fact that the metering cartridge retarding means 830 creates a time delay in communication of this decrease in well annulus pressure to the second side 144 of power piston 140. Thus for a short period of time there is an upward pressure differential acting across power piston 140. This upward pressure differential in combination with the upward biasing force of coil compression spring 866 is sufficient to overcome the holding force of releasable holding means 954, thus providing a slight upward movement of power piston 140 sufficient to disengage the holding pin 958 at which point the coil compression spring 866 itself will continue to move the power piston 140 upward to its first position.

Figure 6E:
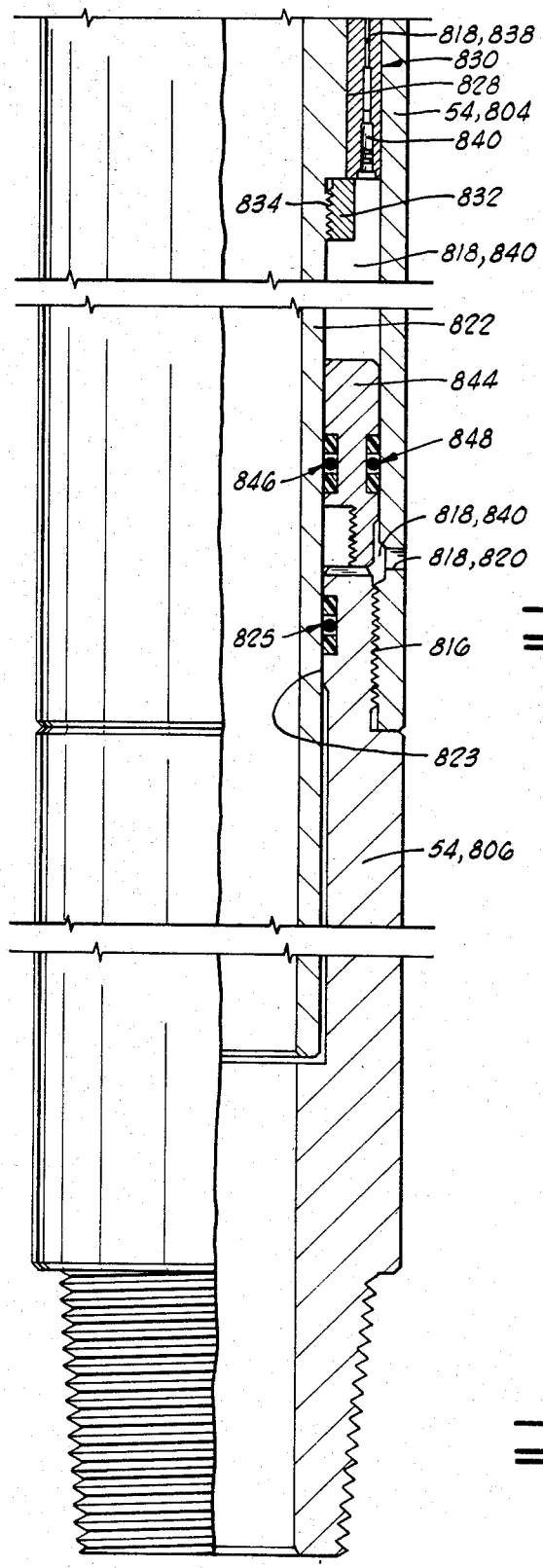

As the power piston 140 moves upward to return to its first position, the annular floating shoe 844 shown in FIG. 6E is displaced upward to account for the volume of fluid which was displaced on the downward movement of the power piston 140.

The number of times which the tester valve 32D can be cycled between the closed and open positions of ball valve means 90 is determined by the volume of fluid in the annular cavity 840 above the annular floating shoe 844. When the annular floating shoe 844 engages the threaded collar 832, the tester valve 32D can no longer be operated. It must then be removed from the well and refilled with fluid.

Thus, it is seen that the methods and apparatus of the present invention readily achieve the ends and advantages mentioned as well as those inherent therein. While certain preferred embodiments of the present invention have been illustrated for the purposes of the present disclosure, numerous changes in the arrangement and construction of parts may be made by those skilled in the art which changes are encompassed within the scope and spirit of the present invention as defined by the appended claims.

What is claimed is:

1. An annulus pressure responsive downhole tool apparatus, comprising:

a tool housing;

a power piston slidably disposed in said housing;

a first pressure conducting passage means for communicating a well annulus with a first side of said power piston;

a second pressure conducting passage means for communicating said well annulus with a second side of said power piston;

retarding means, disposed in said second pressure conducting passage means, for delaying communication of a sufficient portion of an increase in well annulus pressure to said second side of said power piston for a sufficient time to allow a pressure differential from said first side to said second side of said power piston to move said power piston from a first position to a second position relative to said housing; and pressure relief means, communicated with a first portion of said second pressure conducting passage means between said second side of said power piston and said retarding means, for relieving from said first portion of said second pressure conducting passage means a volume of fluid sufficient to permit said power piston to travel to its said second position.

2. The apparatus of claim 1, wherein:

said retarding means is further characterized as also being a means for allowing an additional portion of said increase in well annulus pressure to be communicated to said second side of said power piston after said power piston is moved to its said second position.

3. The apparatus of claim 2, wherein:

said retarding means includes a fluid flow restricting orifice disposed in said second pressure conducting passage means.

4. The apparatus of claim 1, wherein:

said first portion of said second pressure conducting passage means is filled with a first fluid that is sufficiently incompressible such that said power piston would be hydraulically blocked from travelling to its said second position unless said volume of said first fluid were relieved from said first portion of said second pressure conducting passage means by said pressure relief means.

5. The apparatus of claim 1, further comprising:

resilient biasing means, operatively associated with said power piston, for biasing said power piston toward its said first position.

6. The apparatus of claim 5, wherein said biasing means comprises:

a coil compression spring.

7. The apparatus of claim 5, further comprising:

run-in balance means for allowing well annulus pressure to sufficiently balance across said power piston as said apparatus is run into said well so that a pressure differential from said first side to said second side of said power piston is never sufficient to overcome said biasing means and prematurely move said power piston to its said second position as said apparatus is being run into said well.

8. The apparatus of claim 1, further comprising:

run-in balance means for allowing well annulus pressure to sufficiently balance across said power piston as said apparatus is run into said well so that a pressure differential from said first side to said second side of said power piston is never sufficient to prematurely move said power piston to its said second position as said apparatus is being run into said well.

9. The apparatus of claim 8, wherein:

said second pressure conducting passage means includes a bypass portion bypassing said pressure relief means; and said run-in balance means includes check valve means, disposed in said bypass portion, for allowing fluid flow and thus pressure transmission in a first direction from said well annulus through said bypass portion of said second pressure conducting passage means to said second side of said power piston, and for preventing fluid flow through said bypass portion in a reverse direction opposite of said first direction.

10. The apparatus of claim 1, further comprising:

releasable holding means, operatively associated with said power piston, for releasably preventing said power piston from returning to its first position.

11. The apparatus of claim 10, wherein said releasable holding means includes:

a lug connected to said housing;

a J-slot means, operatively associated with said power piston, said lug being received in said J-slot means, said J-slot means and lug providing a means for requiring that in order to return said power piston to its said first position, said power piston must be moved from said second position to a partially returned intermediate holding position, then back to said second position and then back to said first position.

12. The apparatus of claim 1, wherein:

said second pressure conductng passage means contains a sufficient volume of fluid that said apparatus may be operated multiple times to repeatedly move said power piston from its first position to its second position without refilling said said second pressure conducting passage means with fluid.

13. The apparatus of claim 1, wherein said pressure relief means includes:

a relief housing;

a relief port, disposed through said relief housing, and communicating said first portion of said second pressure conducting passage means with a fluid dump zone;

a pressure relief piston means, slidably disposed in said relief housing and movable between a first position wherein said relief port is closed and a second position wherein said relief port is open; and resilient relief piston biasing means for biasing said relief piston toward its said first position.

14. The apparatus of claim 13, wherein:

said tool housing includes an outer tubular housing member which with an inner tubular member disposed concentrically therein defines an annular cavity therebetween, said inner tubular member having a dump passage disposed therethrough, said dump passage being communicated with said fluid dump zone;

said relief housing is cylindrical in shape and is closely received in said annular cavity between said inner and tubular member and said outer tubular housing member, said relief housing having a longitudinal bore disposed through a body thereof said pressure relief piston being slidably disposed in said longitudinal bore; and said relief port communicates said longitudinal bore of said relief housing with said dump passage of said inner tubular member.

15. The apparatus of claim 14, wherein:

said dump zone includes an inner bore of said inner tubular member.

16. The apparatus of claim 13, wherein:

said pressure relief piston divides said first portion of said second pressure conducting passage means into a first part between said power piston and said relief piston, and a second part between said relief piston and said retarding means; and said second part of said first portion of said second pressure conducting passage means contains a sufficient volume of a sufficiently compressible fluid so that when said relief piston is moved from its first position to its second position, said fluid in said second part is compressed by a volume equal to a volume displaced by said relief piston when it is moved from its first to its second position.

17. The apparatus of claim 1, said apparatus being further characterized as a downhole tool valve apparatus, said apparatus further comprising:

valve means, operably associated with said power piston, said valve means being movable between a closed position wherein a flow passage of said valve means is closed and an open position wherein said flow passage is open, said closed and open positions of said valve means corresponding to said first and second positions, respectively, of said power piston.

18. The apparatus of claim 17, wherein:

said flow passage of said valve means is a central bore of said downhole tool valve apparatus.

19. An annulus pressure responsive downhole tool valve apparatus, comprising:

a housing;

a power piston having first and second sides, said power piston being slidably disposed in said housing and movable between first and second positions relative to said housing;

valve means, attached to said power piston, said valve means being movable between closed and open positions corresponding to said first and second positions, respectively, of said power piston, said closed position of said valve means being such that a flow passage of said valve means is closed;

a power passage means for communicating a well annulus with said first side of said power piston;

a low pressure zone, defined within said housing, and communicated with said second side of said power piston; and pressure relief means, communicated with said low pressure zone, for relieving from said low pressure zone a volume of fluid sufficient to permit said power piston to travel from said first position thereof to said second position thereof, said travel being in a direction from said first side toward said second side of said power piston.

20. The apparatus of claim 19, wherein:

said flow passage of said valve means is a central bore of said downhole tool valve apparatus.

21. The apparatus of claim 19, wherein:

said pressure relief means is further characterized as a means for relieving said volume of fluid from said low pressure zone to a central bore of said downhole tool valve apparatus.

22. The apparatus of claim 19, further comprising:

resilient biasing means, operatively associated with said power piston, for biasing said power piston toward its said first position.

23. The apparatus of claim 22, wherein said biasing means comprises:

a coil compression spring.

24. A method of operating an annulus pressure responsive downhole tool of the type including a power piston slidably disposed in a housing and first and second pressure conducting passages communicating a well annulus with first and second sides of said power piston, said method comprising the steps of:

applying an increase in annulus fluid pressure to an annulus fluid in said well annulus;

communicating said increase in annulus fluid pressure to said first side of said power piston through said first pressure conducting passage;

delaying communication of a sufficient portion of said increase in annulus fluid pressure to said second side of said power piston a sufficient time to allow a pressure differential from said first side to said second side of said power piston to move said power piston from a first position thereof to a second position relative to said housing; and relieving from said second pressure conducting passage a volume of fluid sufficient to permit said power piston to travel to its said second position.

25. The method of claim 24, further comprising the step of:

allowing an additional portion of said increase in annulus fluid pressure to be communicated to said second side of said power piston after said power piston is moved to its said second position.

26. The method of claim 24, said second pressure conducting passage being filled with a first fluid, said method further comprising the step of:

hydraulically blocking, by means of said first fluid, said power piston from moving to its said second position until said relieving step is commenced.

27. The method of claim 24, further comprising the step of:

resiliently biasing said power piston toward its said first position.

28. The method of claim 27, further comprising the steps of:

running said tool into said well; and sufficiently balancing well annulus pressure across said power piston as said tool is run into said well so that a pressure differential from said first side to said second side of said power piston is never sufficient to overcome said resilient biasing and prematurely move said power piston to its second position as said tool is being run into said well.

29. The method of claim 24, further comprising the steps of:

running said tool into said well; and sufficiently balancing well annulus pressure across said power piston as said tool is run into said well so that a pressure differential from said first side to said second side of said power piston is never sufficient to prematurely move said power piston to its second position as said tool is being run into said well.

30. The method of claim 24, further comprising the step of:

releasably preventing said power piston from returning to its first position.

31. The method of claim 24, further comprising the steps of:

repeatedly moving said power piston from its first to its second position and repeatedly relieving volumes of fluid from said second pressure conducting passage, without refilling said second pressure conducting passage with fluid.

32. A method of operating an annulus pressure responsive downhole tool of the type including a power piston slidably disposed in a housing, a valve means operatively associated with said power piston, first and second pressure conducting passages communicating an annulus of a well with first and second sides of said power piston, and a pressure relief means disposed in said second pressure conducting passage, said power piston being movable between first and second positions relative to said housing corresponding to closed and open positions, respectively, of said valve means, said method comprising the steps of:

running said tool down into said well with said valve means in its said closed position closing a flow passage of said valve means, and with said power piston in its said first position;

resiliently biasing said power piston toward its said first position with a resilient biasing means;

sufficiently balancing well annulus pressure across said power piston as said tool is run into said well so that a pressure differential from said first side to said second side of said power piston is never sufficient to overcome said resilient biasing means and prematurely move said power piston to its second position as said tool is being run into said well;

setting a packer means, connected to said tool, in said well to separate said well annulus into upper and lower portions, said first and second pressure conducting passages being communicated with said upper portion, and said flow passage of said valve means being communicated with said lower portion of said well annulus;

applying an increase in annulus fluid pressure to an annulus fluid in said upper portion of said well annulus;

communicating said increase in annulus fluid pressure to said first side of said power piston through said first pressure conducting passage;

delaying communication of a sufficient portion of said increase in annulus fluid pressure to said second side of said power piston a sufficient time to allow a pressure differential from said first side to said second side of said power piston to move said power piston to its said second position;

opening said pressure relief means during said time of delayed communication;

moving said power piston from its first position to its second position;

relieving from said second pressure conducting passage, as said power piston moves from its first position to its second position, a volume of fluid sufficient to permit said power piston to travel to its said second position; and thereby moving said valve means to its said open position opening said flow passage of said valve means as said power piston is moved to its said second position.

33. The method of claim 32, wherein said flow passage of said valve means is a central bore of said tool.

34. The method of claim 33, wherein:

said relieving step is further characterized as relieving said volume of fluid into said central bore of said tool.

35. The method of claim 32, further comprising the step of:

allowing an additional portion of said increase in annulus fluid pressure to be communicated to said second side of said power piston after said power piston is moved to its said second position.

36. The method of claim 32, further comprising the step of:

releasably preventing said power piston from returning to its first position, by means of a releasable holding means.

37. The method of claim 32, further comprising the steps of:

applying, for a second time, an increase in annulus fluid pressure to said annulus fluid in said upper portion of said well annulus;

thereby moving said releasable holding means to a released position;

then applying a decrease in annulus fluid pressure to said annulus fluid in said upper portion of said well annulus;

communicating said decrease in annulus fluid pressure to said first side of said power piston through said first pressure conducting passage;

returning said power piston to its said first position by means of said resilient biasing means;

thereby moving said valve means to its said closed position closing said flow passage of said valve means; and bypassing fluid through said second pressure conducting passage past said pressure relief means to said second side of said power piston, as said power piston returns to its said first position.

38. The method of claim 37, wherein:

prior to said step of applying, for a second time, an increase in annulus fluid pressure, the pressure of said annulus fluid is initially decreased from the first increase thereof, and said initially decreased pressure is held for a sufficient time so that said initially decreased pressure is substantially equalized across said power piston.

* * * * *

UNITED STATES PATENT AND TRADEMARK OFFICE

CERTIFICATE OF CORRECTION

PATENT NO. : 4,537,258

DATED : August 27, 1985

INVENTOR(S) : Harold K. Beck

It is certified that error appears in the above-identified patent and that said Letters Patent is hereby corrected as shown below:

In column 3, line 55, following the word "annulus" insert the word --pressure--.

In column 4, line 65, delete the word [packet] and insert therefor --packer--.

In column 6, line 21, delete the numeral [28] and insert therefor --2B--.

In column 14, line 10, delete the word [in].

In column 18, line 54, delete the word [relative] and insert therefor --relatively--.

In column 19, line 62, delete the word [annular] and insert therefor --annulus--.

In column 25, line 59, following the word "lower" insert the word --inner--.

In column 28, line 38, following the words "testing string" delete the word [is].

In column 29, line 42, delete the word [These] and insert therefor --There--.

In column 30, line 56, following the words "down to" delete the word [the].

UNITED STATES PATENT AND TRADEMARK OFFICE

CERTIFICATE OF CORRECTION

PATENT NO. : 4,537,258

DATED : August 27, 1985

INVENTOR(S) : Harold K. Beck

It is certified that error appears in the above-identified patent and that said Letters Patent is hereby corrected as shown below:

In column 32, line 21, delete the word [where] and insert therefor --were--.
In column 34, line 21, delete the word [it] and insert therefor --its--.
In column 34, line 62, delete the word [placed] and insert therefor --place--.
In column 40, line 5, following the word "refilling" delete the first instance of the word [said].
In column 41, line 61, following the word "position" insert the word --thereof--.

Signed and Sealed this

*Twenty-sixth* Day of *August 1986*

[SEAL]

*Attest:*

DONALD J. QUIGG

*Attesting Officer*

*Commissioner of Patents and Trademarks*